US011383514B2

(12) United States Patent
Gardner et al.

(10) Patent No.: US 11,383,514 B2
(45) Date of Patent: Jul. 12, 2022

(54) DIE FOR A PRINTHEAD

(71) Applicant: Hewlett-Packard Development Company, L.P., Spring, TX (US)

(72) Inventors: James Michael Gardner, Corvallis, OR (US); Anthony M. Fuller, Corvallis, OR (US); Scott A. Linn, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 16 days.

(21) Appl. No.: 16/956,709

(22) PCT Filed: Feb. 6, 2019

(86) PCT No.: PCT/US2019/016791
§ 371 (c)(1),
(2) Date: Jun. 22, 2020

(87) PCT Pub. No.: WO2020/162915
PCT Pub. Date: Aug. 13, 2020

(65) Prior Publication Data

US 2021/0370671 A1 Dec. 2, 2021

(51) Int. Cl.
*B41J 2/045* (2006.01)

(52) U.S. Cl.
CPC ..... *B41J 2/04581* (2013.01); *B41J 2/04585* (2013.01)

(58) Field of Classification Search
CPC . B41J 2/14072; B41J 2/04563; B41J 2/14153
See application file for complete search history.

(56) References Cited

U.S. PATENT DOCUMENTS

| | | | | |
|---|---|---|---|---|
| 5,278,584 | A | 1/1994 | Keefe et al. | |
| 5,942,900 | A * | 8/1999 | DeMeerleer ..... | B41J 29/393 324/537 |
| 6,039,438 | A | 3/2000 | Beerling | |
| 6,378,978 | B1 | 4/2002 | Chang et al. | |
| 6,398,348 | B1 | 6/2002 | Haluzak et al. | |
| 7,571,975 | B2 | 8/2009 | Lee et al. | |
| 8,870,337 | B1 | 10/2014 | Jensen et al. | |
| 8,888,226 | B1 | 11/2014 | Gardner et al. | |

(Continued)

FOREIGN PATENT DOCUMENTS

| | | | |
|---|---|---|---|
| CN | 107206815 | A | 9/2017 |
| CN | 109313154 | A | 2/2019 |

(Continued)

OTHER PUBLICATIONS

Ryu, Donghyeon, et al., Inkjet-printed, flexible, and photoactive thin film strain sensors, Aug. 2014, ResearchGate.

(Continued)

*Primary Examiner* — Lam S Nguyen
(74) *Attorney, Agent, or Firm* — HP Inc. Patent Department

(57) ABSTRACT

A die for a printhead is described herein. The die includes a number of fluid feed holes disposed in a line parallel to a longitudinal axis of the die. A number of fluidic actuators are disposed in a line parallel to the fluid feed holes. A crack detector trace is routed between each of the plurality of fluid feed holes.

17 Claims, 22 Drawing Sheets

302

(56) References Cited

U.S. PATENT DOCUMENTS

| | | | | |
|---|---|---|---|---|
| 10,933,634 | B2 * | 3/2021 | Fuller | B41J 2/1629 |
| 2013/0070012 | A1 | 3/2013 | Yokouchi | |
| 2017/0355185 | A1 * | 12/2017 | Anderson | B41J 2/04501 |

FOREIGN PATENT DOCUMENTS

| | | | |
|---|---|---|---|
| JP | 2016-203403 | A | 12/2016 |
| WO | WO-2016122654 | A1 | 8/2016 |

OTHER PUBLICATIONS

Xu, Yuanyuan, et al., The Boom in 3D-Printed Sensor Technology, May 19, 2018, MDPI.

* cited by examiner

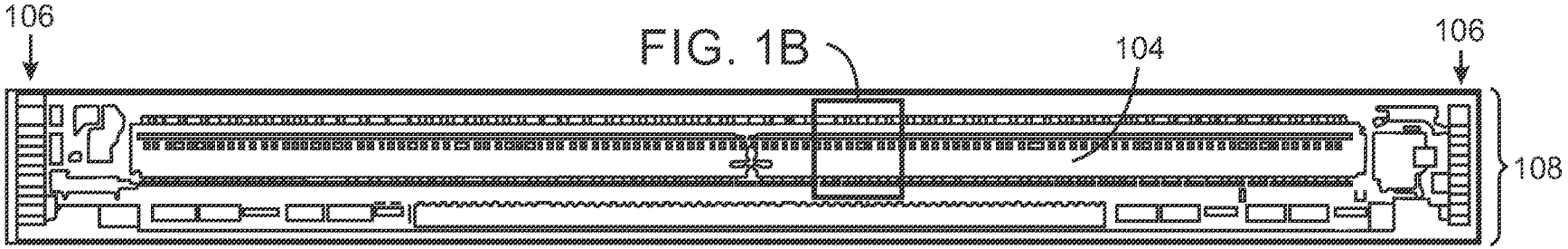
FIG. 1B
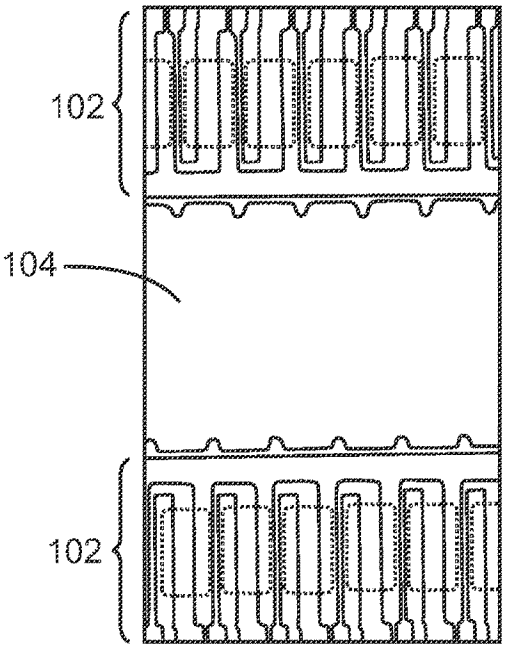
FIG. 1A (Prior Art)
FIG. 1B (Prior Art)

300

300

300

400

304

304

900

1000

1100

1200

1300

302

304

304

304

302

302

302

2200

DIE FOR A PRINTHEAD

CROSS-REFERENCE TO RELATED APPLICATION

Pursuant to 35 U.S.C. § 371, this application is a United States National Stage Application of PCT Patent Application Serial No. PCT/US2019/016791, filed on Feb. 6, 2019, the contents of which are incorporated by reference as if set forth in their entirety herein.

BACKGROUND

A printing system, as one example of a fluid ejection system, may include a printhead, an ink supply which supplies liquid ink to the printhead, and an electronic controller which controls the printhead. The printhead ejects drops of print fluid through a plurality of nozzles or orifices onto a print medium. Suitable print fluids may include inks and agents for two-dimensional or three-dimensional printing. The printheads may include thermal or piezo printheads that are fabricated on integrated circuit wafers or dies. Drive electronics and control features are first fabricated, then the columns of heater resistors are added and finally the structural layers, for example, formed from photo-imageable epoxy, are added, and processed to form microfluidic ejectors, or drop generators. In some examples, the microfluidic ejectors are arranged in at least one column or array such that properly sequenced ejection of ink from the orifices causes characters or other images to be printed upon the print medium as the printhead and the print medium are moved relative to each other.

BRIEF DESCRIPTION OF THE DRAWINGS

Certain examples are described in the following detailed description and in reference to the drawings, in which:

FIG. 1A is a view of an example of a die used for a printhead;

FIG. 1B is an enlarged view of a portion of the die;

DETAILED DESCRIPTION OF SPECIFIC EXAMPLES

Figure 2A:
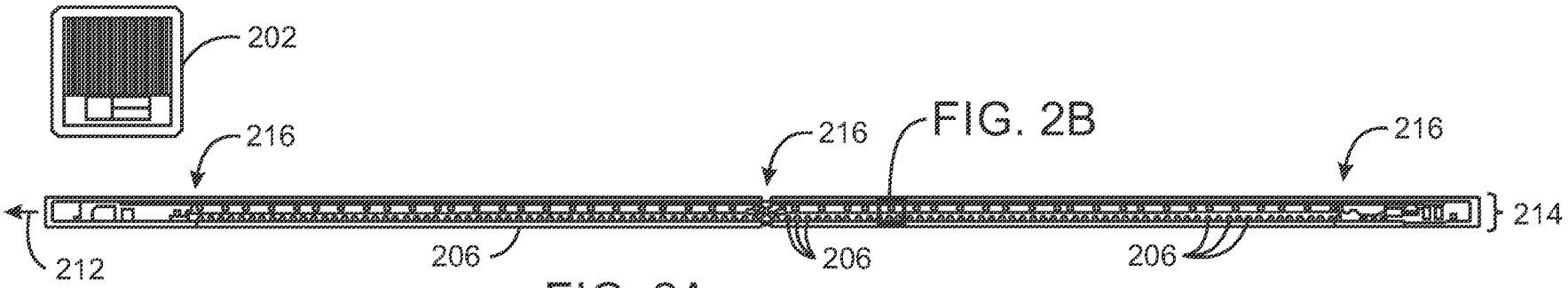
FIG. 2A is a view of an example of a die used for a printhead.

Printheads are formed using die having fluidic actuators, such as microfluidic ejectors and microfluidic pumps. The fluidic actuators can be based on thermal or piezoelectric technologies, and are formed using long, narrow pieces of silicon, termed dies herein. As used herein, a fluidic actuator is a device on a die that forces a fluid from a chamber and includes the chamber and associated structures. In examples described herein, one type of fluidic actuator, a microfluidic ejector, is used as a drop ejector, or nozzle in a die used for printing and other applications. For example, printheads can be used as fluid ejection devices in two-dimensional and three-dimensional printing applications and other high precision fluid dispensing systems including pharmaceutical, laboratory, medical, life science and forensic applications.

The cost of printheads is often determined by the amount of silicon used in the dies, as the cost of the die and the fabrication process increase with the total amount of silicon used in a die. Accordingly, lower cost printheads may be formed by moving functionality off the die to other integrated circuits, allowing for smaller dies.

Many current dies have an ink feed slot in the middle of the die to bring ink to the fluidic actuators. The ink feed slot generally provides a barrier to carrying signals from one side of an die to another side of a die, which often requires duplicating circuitry on each side of the die, further increasing the size of the die. In this arrangement, fluidic actuators on one side of the slot, which may be termed left or west, have independent addressing and power bus circuits from fluidic actuators on the opposite side of the ink feed slot, which may be termed right or east.

Examples described herein provide a new approach to providing fluid to the fluidic actuators of the drop ejectors. In this approach, the ink feed slot is replaced with an array of fluid feed holes disposed along the die, proximate to the fluidic actuators. The array of fluid feed holes disposed along the die may be termed a feed zone, herein. As a result, signals can be routed through the feed zone, between the fluid feed holes, for example, from the logic circuitry located on one side of the fluid feed holes to printing power circuits, such as field-effect transistors (FETs), located on the opposite side of the fluid feed holes. This is termed cross-slot routing herein. The circuitry to route the signals includes traces that are provided in layers between adjacent ink or fluid feed holes.

As used herein, a first side of the die and a second side of the die denote the long edges of the die that are in alignment with the fluid feed holes, which are placed near or at the center of the die. Further, as used herein, the fluidic actuators are located on a front face of the die, and the ink or fluid is fed to the fluid feed holes from a slot on the back face of the die. Accordingly, the width of the die is measured from the edge of the first side of the die to the edge of the second side of the die. Similarly, the thickness of the die is measured from the front face of the die to the back face of the die.

The cross-slot routing allows for the elimination of duplicate circuitry on the die, which can decrease the width of the die, for example, by 150 micrometers (μm) or more. In some examples, this may provide a die with a width of about 450 μm or about 360 μm, or less. In some examples, the elimination of duplicate circuitry by the cross-slot routing may be used to increase the size of the circuitry on the die, for example, to enhance performance in higher value applications. In these examples, the power FETs, the circuit traces, power traces, and the like, may be increased in size. This may provide dies that are capable of higher droplet weights. Accordingly, in some examples, the dies may be less than about 500 μm, or less than about 750 μm, or less than about 1000 μm.

The thickness of the die from the front face to the back face is also decreased by the efficiencies gained from the use of the fluid feed holes. Previous dies that use ink feed slots may be greater than about 675 μm, while dies using the fluid feed holes may be less than about 400 μm in thickness. The length of the dies may be about 10 millimeters (mm), about 20 mm, or about 20 mm, depending on the number of fluidic actuators used for the design. The length of the dies includes space at each end of the die for circuitry, accordingly the fluidic actuators occupy a portion of the length of the die. For example, for a black die of about 20 mm in length, the fluidic actuators may occupy about 13 mm, which is the swath length. A swath length is the width of the band of printing, or fluid ejection, formed as a printhead is moved across a print medium.

Further, it allows the co-location of similar devices for increased efficiency and layout. The cross-slot routing also optimizes power delivery by allowing left and right columns, or fluidic actuator zones, of multiple fluidic actuators to share power and ground routing circuits. A narrower die may be more fragile than a wider die. Accordingly, the die may be mounted in a polymeric potting compound that has a slot from a reverse side to allow ink to flow to the fluid feed holes. In some examples, the potting compound is an epoxy, although it may be an acrylic, a polycarbonate, a polyphenylene sulfide, and the like.

The cross-slot routing also allows for the optimization of circuit layout. For example, the high-voltage and low-voltage domains may be isolated on opposite sides of the fluid feed holes allowing for improvements in reliability and form factor for the dies. The separation of the high-voltage and low-voltage domains may decrease or eliminate parasitic voltages, crosstalk, and other issues that affect the reliability of the die. Further, repeat units that include the logic circuits, fluidic actuators, fluid feed holes, and power circuitry for a set of nozzles may be designed to provide the desired pitch in a very narrow form factor.

The fluid feed holes placed in a line parallel to a longitudinal axis of the die may make the die more susceptible to damage from mechanical stresses. For example, the fluid feed holes may act as a series of perforations that increase the chance that a crack will develop through the fluid feed holes along the longitudinal axis of the die. To detect cracks during manufacturing, for example, before mounting in the potting compound, a crack detection circuit may be placed around the fluid feed holes in a serpentine manner. The crack detection circuit may be a resistor that breaks if a crack forms, causing the resistance to go from a first resistance, such as hundreds of kiloohms, to an open circuit. This may lower production costs by identifying broken dies prior to completion of the manufacturing process.

The die used for a printhead, as described herein, uses resistors to heat fluids in the fluidic actuator causing droplet ejection by thermal expansion. However, the dies are not limited to thermally driven fluidic actuators and may use piezoelectric fluidic actuators that are fed from fluid feed holes. As described herein, the fluidic actuator includes the driver and associated structures, such as the fluid chamber and a nozzle for a microfluidic ejector.

Further, the die may be used in to form fluidic actuators for other applications besides a printhead, such as microfluidic pumps, used in analytical instrumentation. In this example, the fluidic actuators may be fed test solutions, or other fluids, rather than ink, from fluid feed holes. Accordingly, in various examples, the fluid feed holes and inks can be used to provide fluidic materials that may be ejected or pumped by droplet ejection from thermal expansion or piezoelectric activation.

FIG. 1A is a view of an example of a die 100 used for a printhead. The die 100 includes all circuitry to operate fluidic actuators 102 on both sides of a fluid feed slot 104. Accordingly, all electrical connections are brought out on pads 106 located at each end of the die 100. As a result, the width 108 of the die is about 1500 μm. FIG. 1B is an enlarged view of a portion of the die 100. As can be seen in this enlarged view, the fluid feed slot 104 occupies a substantial amount of space in the center of the die 100, increasing the width 108 of the die 100.

Figure 2B:
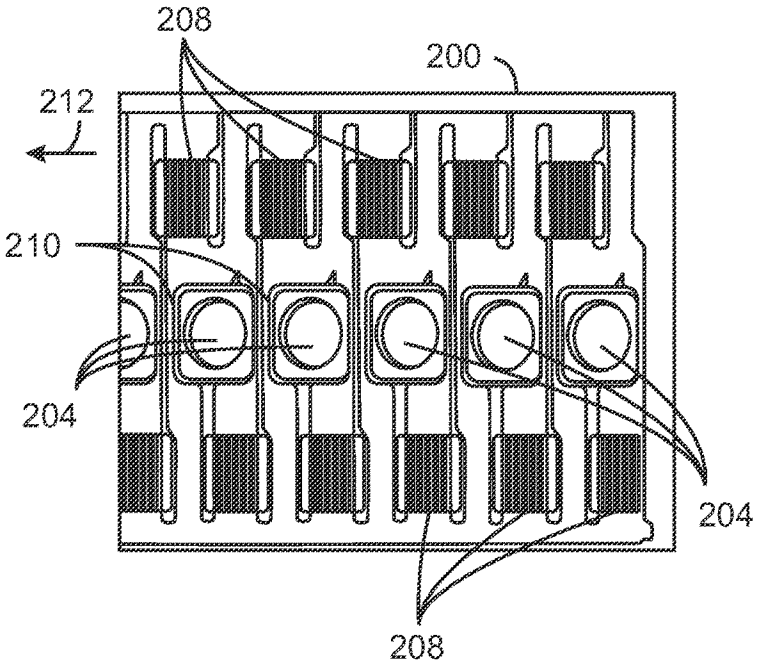
FIG. 2B is an enlarged view of a portion of the die.

FIG. 2A is a view of an example of a die 200 used for a printhead. FIG. 2B is an enlarged cross-section of a portion of the die 200. In comparison with the die 100 of FIG. 1A, the design of the die 200 allows a portion of the activation circuitry to a secondary integrated circuit, or application specific integrated circuit (ASIC) 202.

In contrast to the fluid feed slot 104 of the die 100, the die 200 uses fluid feed holes 204 to provide fluid, such as inks, to the fluidic actuators 206 for ejection by thermal resistors 208. As described herein, the cross-slot routing allows circuitry to be routed along silicon bridges 210 between the fluid feed holes 204 and across the longitudinal axis 212 of the die 200. This allows the width 214 of the die 200 to be substantially decreased over previous designs that did not have the fluid feed holes 204.

The decrease in the width 214 of the die 200 decreases costs substantially, for example, by decreasing the amount of silicon in the substrate of the die 200. Further, the distribution of circuitry and functions between the die and the ASIC 202 allows further decreases in the width 214. As described herein, the die 200 also includes sensor circuitry for operations and diagnostics. In some examples, the die 200 includes thermal sensors 216, for example, placed along the longitudinal axis of the die near one end of the die, at the middle of the die, and near the opposite end of the die.

Figure 3B:
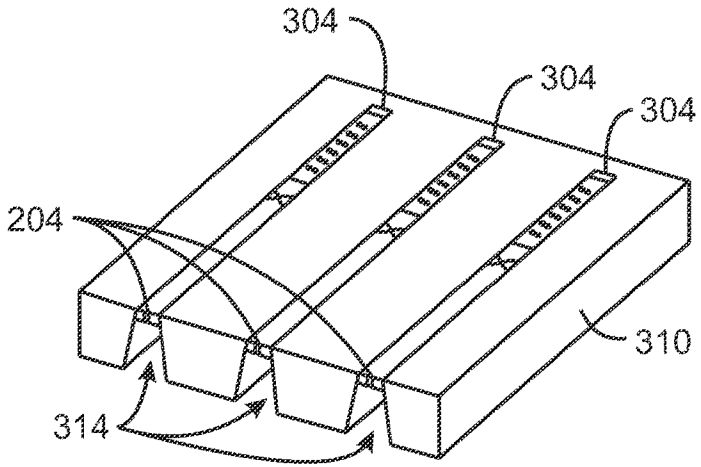
FIG. 3B is a drawing of an example of a printhead formed using color dies, which may be used for three colors of ink.
Figure 3A:
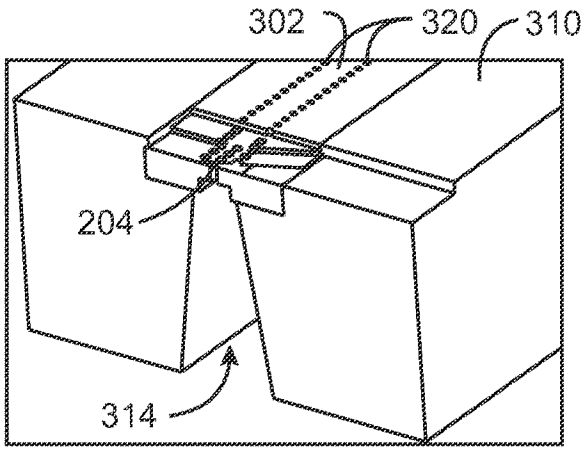
FIG. 3A is a drawing of an example of a printhead formed from a black die that is mounted in a potting compound.
Figure 3C:
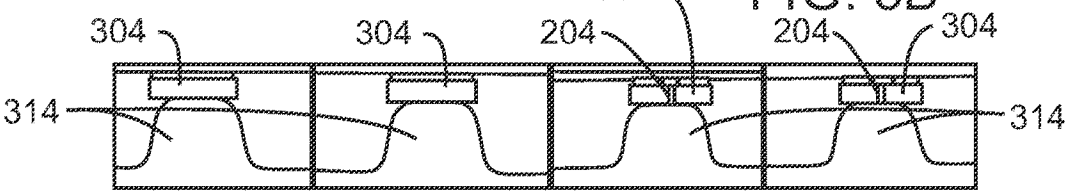
FIG. 3C shows cross-sectional views of the printheads including mounted dies through solid sections and through sections having fluid feed holes.
Figure 3C:
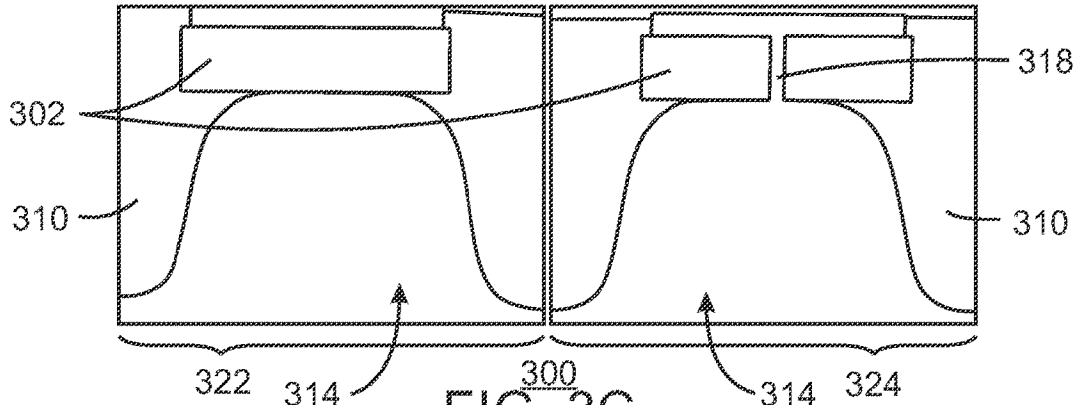

FIGS. 3A to 3C are drawings of the formation of a printhead 300 by the mounting of dies 302 or 304 in a polymeric mount 310 formed from a potting compound. The dies 302 and 304 are too narrow to attach to pen bodies or fluidically route fluid from reservoirs. Accordingly, the dies 302 and 304 are mounted in a polymeric mount 310 formed from a potting compound, such as an epoxy material, among others. The polymeric mount 310 of the printhead 300 has slots 314 which provide an open region to allow fluid to flow from the reservoir to the fluid feed holes 204 in the dies 302 and 304.

FIG. 3A is a drawing of an example of a printhead 300 formed from a black die 302 that is mounted in a potting compound. In the black die 302 of FIG. 3A, two lines of nozzles 320 are visible, wherein each group of two alternating nozzles 320 are fed from one of the fluid feed holes 204 along the black die 302. Each of the nozzles 320 is an opening to a fluid chamber above a thermal resistor. Actuation of the thermal resistor forces fluid out through the nozzles 320, thus, each combination of thermal resistor fluid chamber and nozzle represents a fluidic actuator, specifically, a microfluidic ejector. It may be noted that the fluid feed holes 204 are not isolated from each other, allowing fluid to flow from fluid feed holes 204 to nearby fluid feed holes 204, providing a higher flow rate for the active nozzles.

FIG. 3B is a drawing of an example of a printhead 300 formed using color dies 304, which may be used for three colors of ink. For example, one color die 304 may be used for a cyan ink, another color die 304 may be used for a magenta ink, and a last color die 304 may be used for a yellow ink. Each of the inks will be fed into the associated slot 314 of the color dies 304 from a separate color ink reservoir. Although this drawing shows only three of the color dies 304 in the mount, a fourth die, such as a black die 302, may be included to form a CMYK die. Similarly, other die configurations may be used.

FIG. 3C shows cross-sectional views of the printheads 300 including mounted dies 302 or 304 through solid sections 322 and through sections 324 having fluid feed holes 318. This shows that the fluid feed holes 318 are coupled to the slots 314 to allow ink to flow from the slots 314 through the mounted dies 302 and 304. As described herein, the structures in FIGS. 3A to 3C are not limited to inks but may be used to provide other fluids to fluidic actuators in dies.

Figure 4:
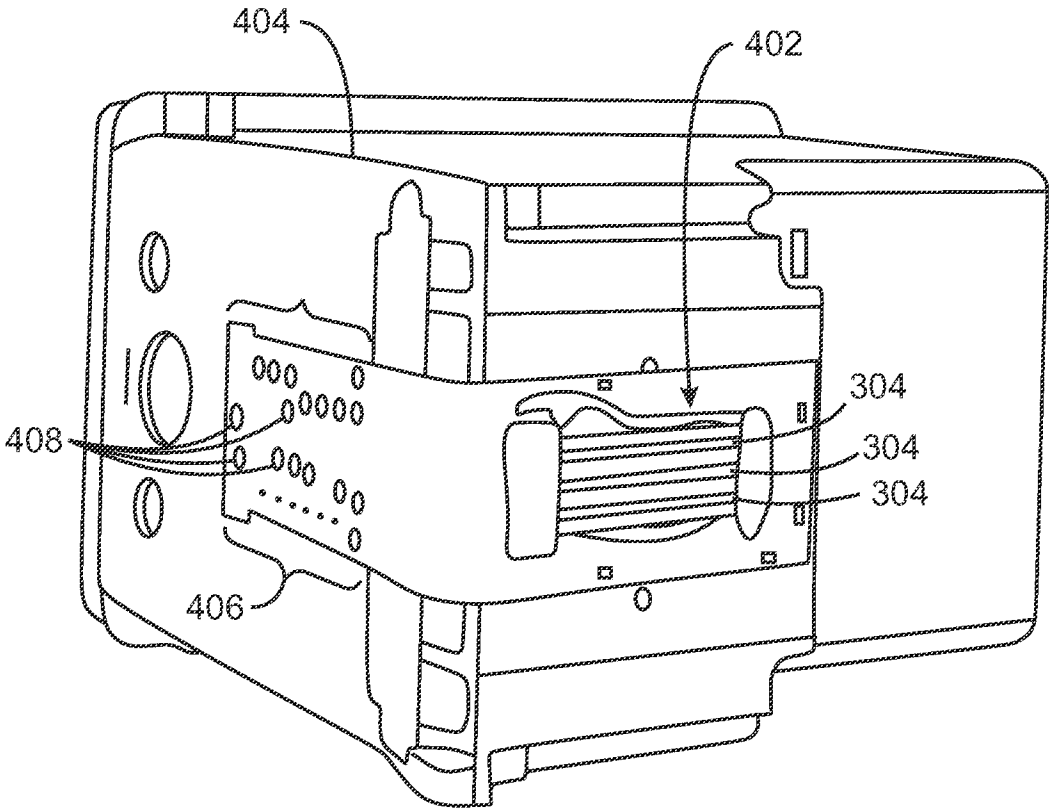
FIG. 4 is a printer cartridge that incorporates the color dies described with respect to FIG. 3B.

FIG. 4 is an example of a printer cartridge 400 that incorporates the color dies 304 described with respect to FIG. 3B. The mounted color dies 304 form a pad 402. As described herein the pad 402 includes the multicolor silicon dies, and the polymeric mounting compound, such as an epoxy potting compound. The housing 404 holds the ink reservoir used to feed the mounted color dies 304 in the pad 402. A flex connection 406, such as a flexible circuit, holds the printer contacts, or pads, 408 used to interface with the printer cartridge 400. The different circuit design, as described herein, allows for fewer pads 408 to be used in the printer cartridge 400 versus previous printer cartridges.

Figure 5:
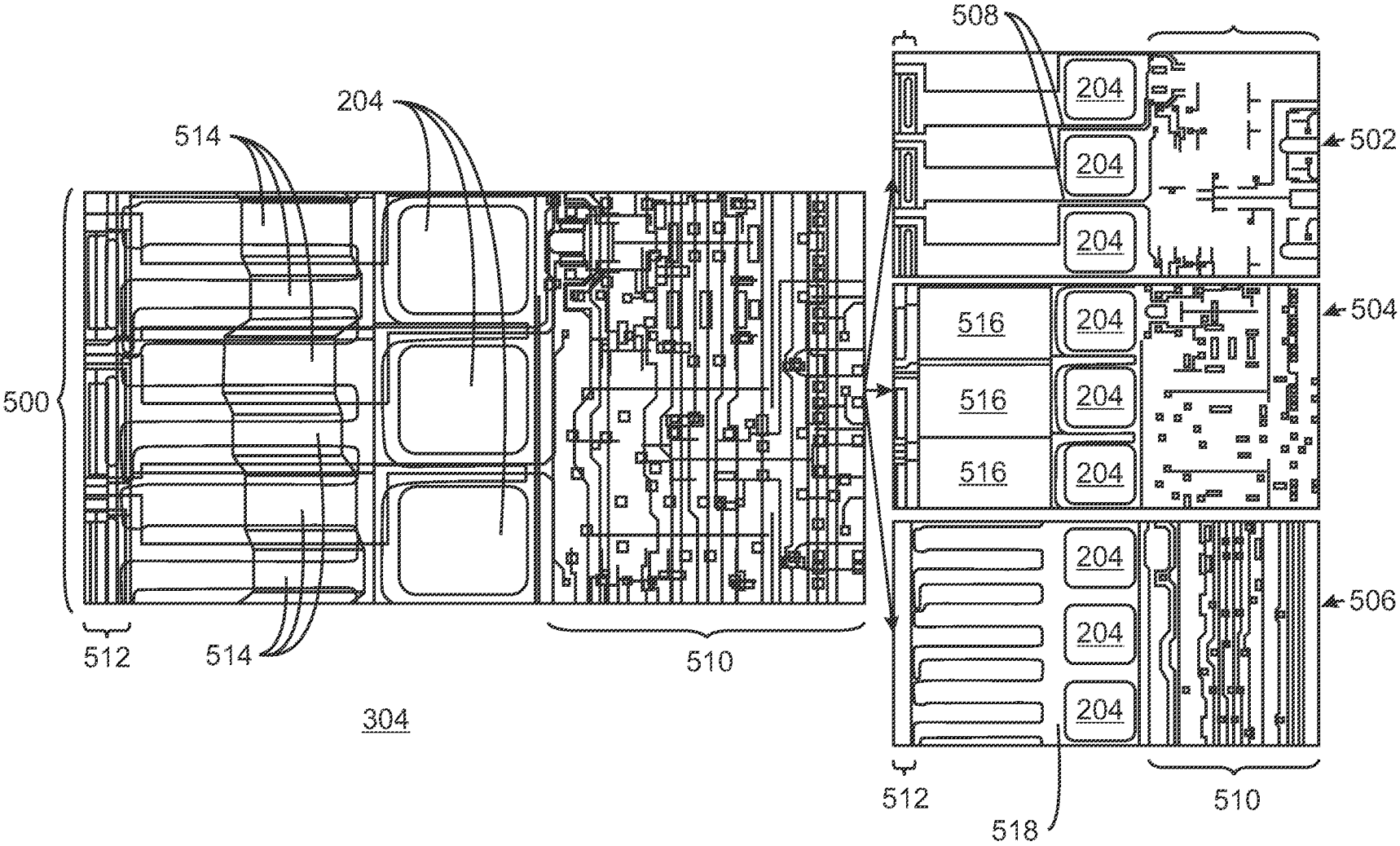
FIG. 5 is a drawing of a portion of an example of a color die showing layers used to form the color die.

FIG. 5 is a drawing of a portion 500 of a color die 304 showing layers 502, 504, and 506 used to form the color die 304. Like numbered items are described as with respect to FIG. 2. The materials used to make the layers include polysilicon, aluminum-copper (AlCu), Tantalum (Ta), Gold (Au), implant doping (Nwell, Pwell, and etc.). In the drawing, layer 502 shows the routing of layers, or polysilicon traces, 508 from logic circuitry 510 of the color die 304 between the fluid feed holes 204 to field-effect transistors (FETs) forming power circuitry 512 of the color die 304 (partially shown in the drawing). This allows the energization of the FETs to drive the thermal inkjet resistors (TIJ) 514 that power the fluidic actuators to force liquid out of the chamber above the thermal resistor. Additional layers 516 and 518, may include metal 1 504 and metal 2 506, are used as power ground returns for the current to the TIJ resistors 514. It may also be noted that the color die 304 shown in FIG. 5 is the TIJ resistors 514 placed only on one side of the fluid feed holes 204, which alternates between high weight droplets (HWD) and low weight droplets (LWD) to provide different drop sizes for increasing drop accuracy. To control the drop weights, the TIJ resistors 514, and associated structures, for the HWD are larger than the TIJ resistors 514 used for the LWD, as discussed further with respect to FIG. 15. As described herein, the associated structures in the fluidic actuator include a fluid chamber and nozzle for a microfluidic ejector. In a black die 302, the TIJ resistors 514, and associated structures, are the same size, and alternate between each side of the fluid feed holes 204.

Figures 6A, 6B:
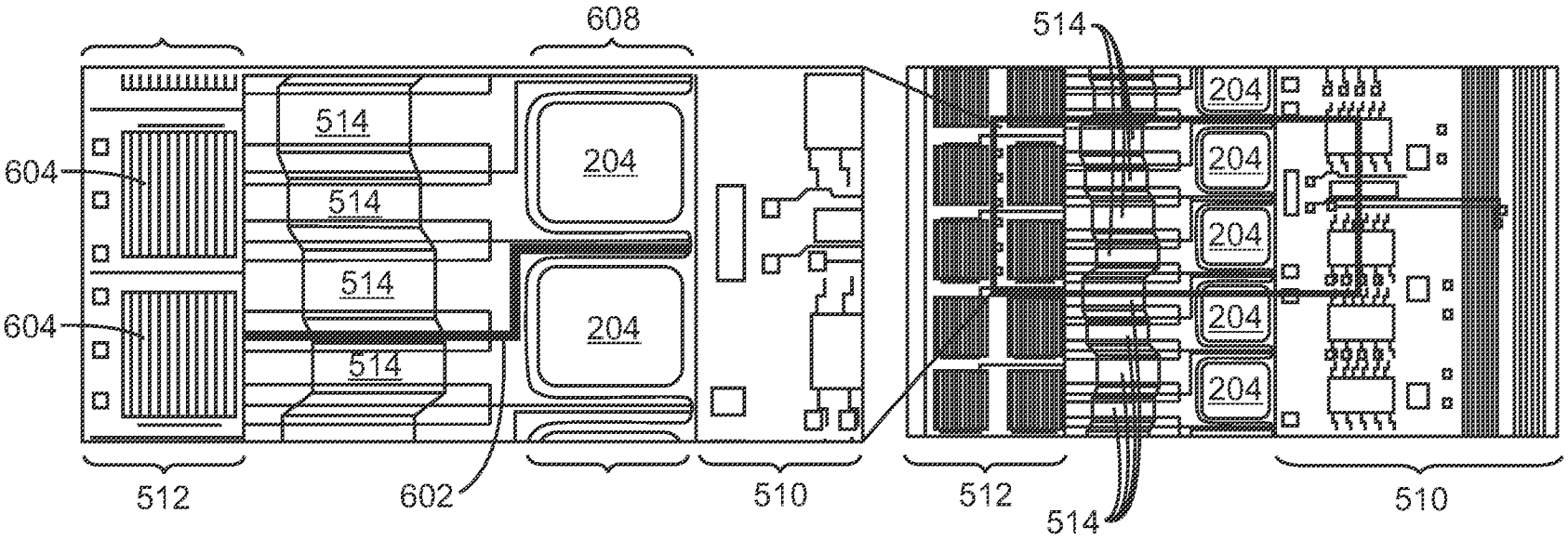
FIGS. 6A and 6B are drawings of the color die showing a close-up view of an example of a polysilicon trace connecting logic circuitry of the color die to FETs on the power side of the color die.

FIGS. 6A and 6B are drawings of the color die 304 showing a close-up view of a trace 602 connecting logic circuitry 510 of the color die 304 to FETs 604 in the power circuitry 512 of the color die 304. Like numbered items are as described with respect FIGS. 2, 3, and 5. The conductors are stacked to allow multiple connections between the left and right sides of the array 608 of the fluid feed holes 204. In examples, the fabrication is performed using complementary metal-oxide semiconductor technology, wherein conductive layers, such as the polysilicon layer, the first metal layer, the second metal layer, and the like, are separated by a dielectric that allows them to be stacked without electrical interference, such as crosstalk. This is described further with respect to FIGS. 7 and 8.

Figure 7B:
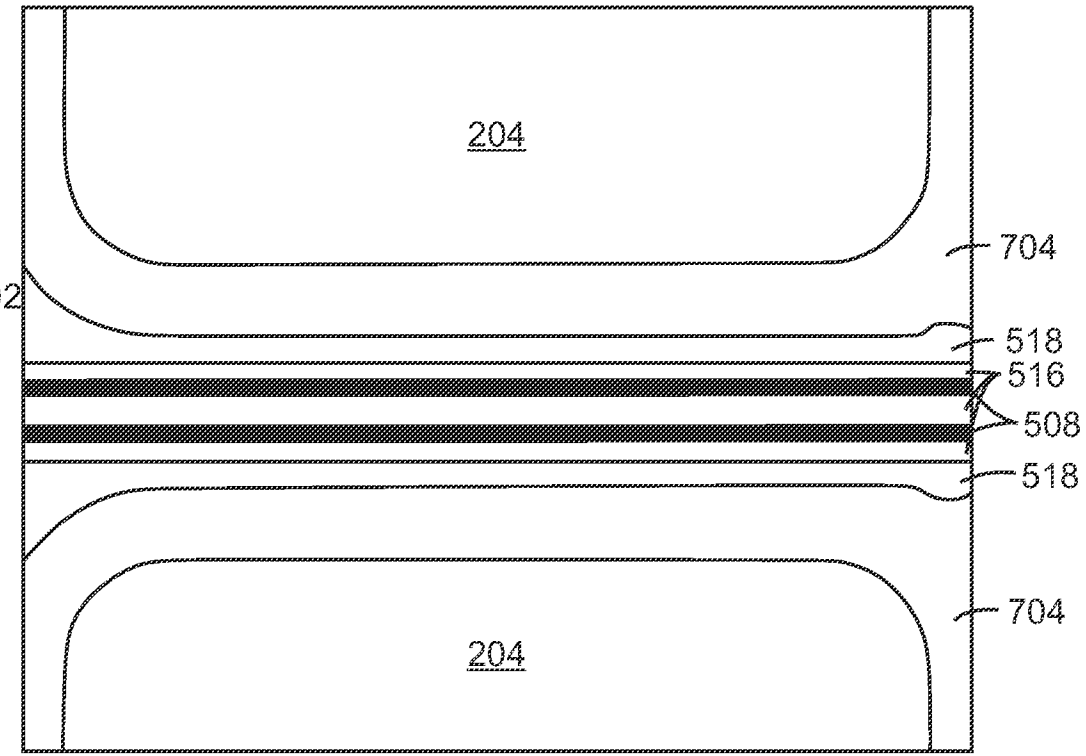
FIGS. 7A and 7B are drawings of the color die showing close-up views of the traces between the fluid feed holes.
Figure 7A:
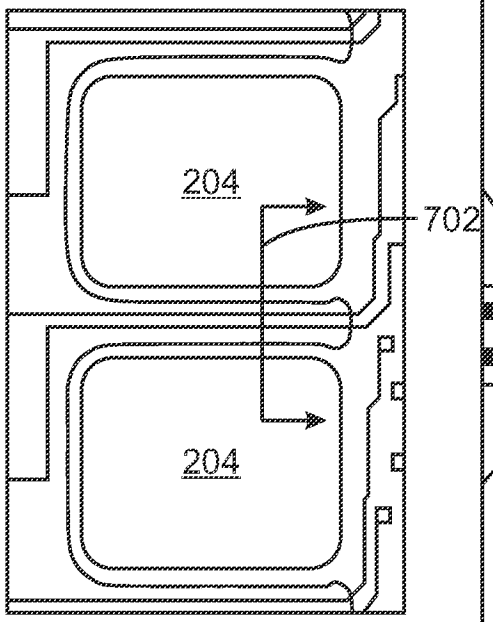

FIGS. 7A and 7B are drawings of the color die 304 showing close-up views of the traces between the fluid feed holes 204. Like numbered items are as described with respect to FIGS. 2 and 5. FIG. 7A is a view of two fluid feed holes 204, while FIG. 7B is an expanded view of the section shown by the line 702. In this view of the different layers between the fluid feed holes 204 can be seen including a tantalum layer 704. Further the layers described with respect to FIG. 5 are shown, including the polysilicon layer 508, the metal 1 layer 516, and the metal 2 layer 518. In some examples, as described with respect to FIGS. 20 and 21, 1 of the polysilicon traces 508 may be used to provide an embedded crack detector for the color die 304. The layers 508, 516, and 518 are separated by a dielectric to provide insulation, as discussed further with respect to FIGS. 8A and 8B. It should be noted that, although FIGS. 6A, 6B, 7A, and 7B show the color die 304, the same design features are used on the black die 302.

Figure 8B:
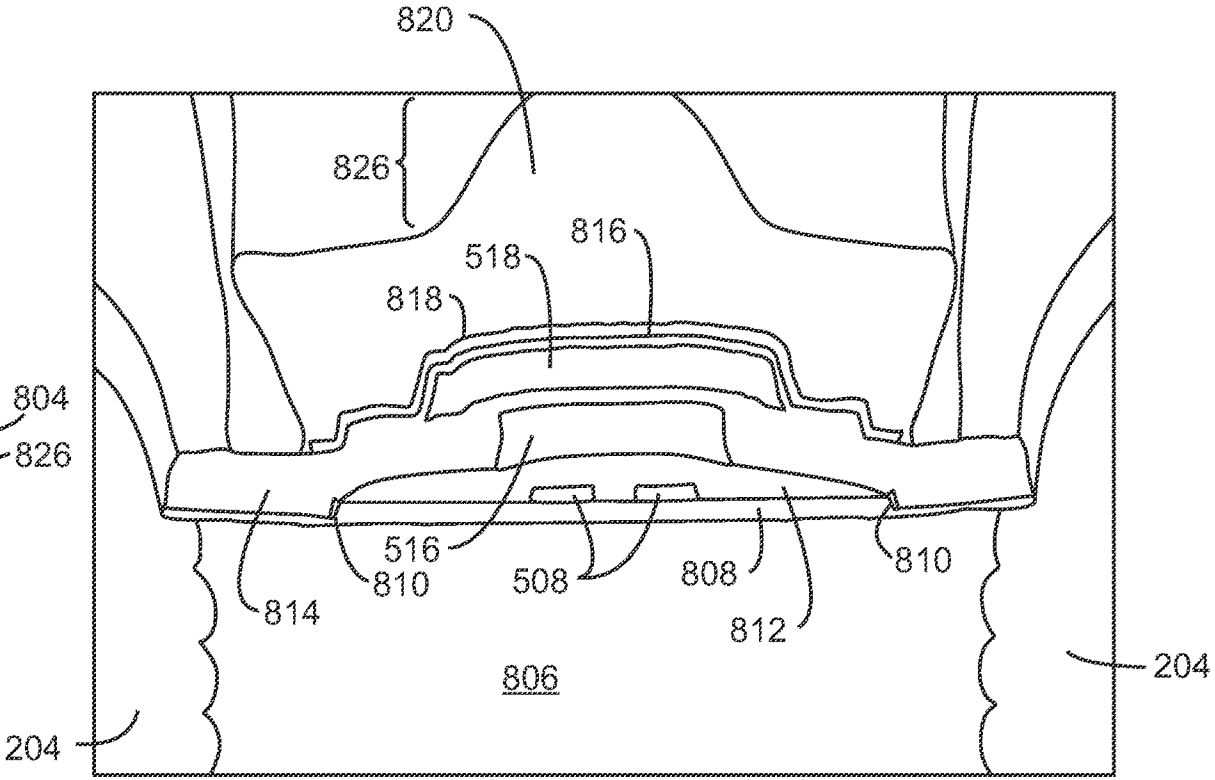
FIGS. 8A and 8B are drawings of an electron micrograph of the section between two fluid feed holes.
Figure 8A:
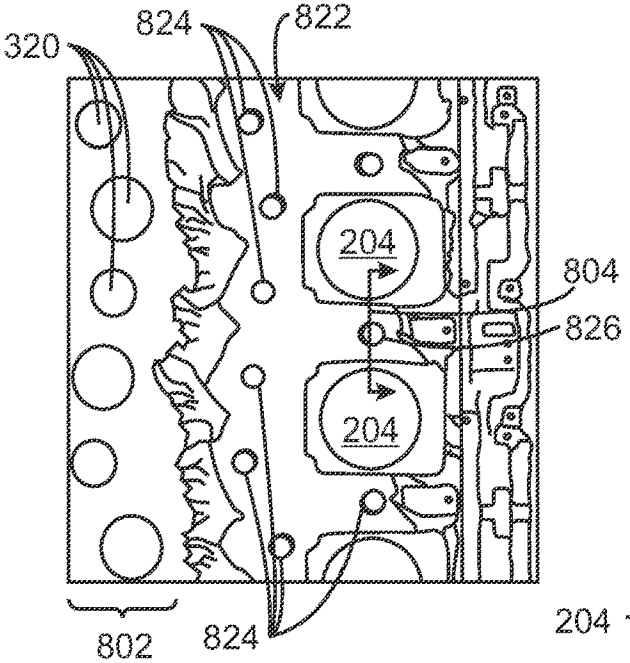

FIGS. 8A and 8B are drawings of an electron micrograph of the section between two fluid feed holes 204 of the color die 304. Like numbered items are as described with respect to FIGS. 2, 3, and 5. The top layer in this structure is a SU-8 primer 802, which is used to form the final covering over the circuitry, including the nozzles 320 for the color die 304. However, the same layers may be present between the fluid feed holes 204 in a black die 302.

FIG. 8B is a cross-section 804 between two fluid feed holes 204 of the color die 304. As shown in FIG. 8B, fluid feed holes 204 are etched through a silicon layer 806, which functions as a substrate, leaving a bridge that connects the two sides of the color die 304. Several layers are deposited on top of the silicon layer 806. A thick field oxide, or FOX layer, 808 is deposited on top of the silicon layer 806 to insulate further layers from the silicon layer 806. A stringer 810, formed from the same material as metal 1 516 is deposited at each side of the FOX layer 808.

On top of the FOX layer 808, the polysilicon layers 508 are deposited, for example, to couple logic circuitry on one side of the die 200 to power transistors on an opposite side of the die 200. Other uses for the polysilicon layers 508 may include crack detection traces deposited between fluid feed holes 204, as described with respect to FIGS. 20 and 21. Polysilicon, or polycrystalline silicon, is a high purity, polycrystalline form of silicon. In examples, it is deposited using low-pressure, chemical-vapor deposition of silane ($SiH_4$). The polysilicon layers 508 may be implanted, or doped, to form n-well and p-well materials. A first dielectric layer 812 is deposited over the polysilicon layers 508 as an insulation barrier. In an example, the first dielectric layer 812 is formed from borophosphosilicate glass/tetraethyl ortho silicate (BPSG/TEOS), although other materials may be used.

A layer of metal 1 516 may then be deposited over the first dielectric layer 812. In various examples, metal 1 516 is formed from titanium nitride (TiN), aluminum copper alloy (AlCu), or titanium nitride/titanium (TiN/Ti), among other materials, such as gold. A second dielectric layer 814 is deposited over the metal 1 516 layer to provide an insulation barrier. In an example, the second dielectric layer 814 is a TEOS/TEOS layer formed by a high-density plasma chemical vapor deposition (HDP-TEOS/TEOS).

A layer of metal 2 518 may then be deposited over the second dielectric layer 814. In various examples, metal 2 518 is formed from a tungsten silicon nitride alloy (WSiN), aluminum copper alloy (AlCu), or titanium nitride/titanium (TiN/Ti), among other materials, such as gold. A passivation layer 816 is then deposited over the top of metal 2 518 to provide an insulation barrier. In an example, the passivation layer 816 is a layer of silicon carbide/silicon nitride (SiC/SiN).

A tantalum (Ta) layer 818 is deposited over the top of the passivation layer 816 and the second dielectric layer 814. The tantalum layer 818 protects the components of the trace from degradation caused by potential exposure to fluids, such as inks. A layer of SU-8 820 is then deposited over the die 200, and is etched to form the nozzles 320 and flow channels 822 over the die 200. SU-8 is an epoxy based negative photoresist, in which parts exposed to a UV light are cross-linked, becoming resistant to solvent and plasma etching. Other materials may be used in addition to, or in place of, the SU-8. The flow channels 822 are configured to feed fluid from the fluid feed holes, or fluid feed holes 204, to the nozzles 320 or fluidic actuators. In each of the flow channels 822, a button 824 or protrusion is formed in the SU-8 820 to block particulates in the fluid from entering the ejection chambers under the nozzles 320. One button 826 is shown in the cross section of FIG. 8B.

The stacking of conductors over the silicon layer 806 between the fluid feed holes 204 increases the connections between left and right sides of the array of fluid feed holes 204. As described herein, the polysilicon layer 508, metal 1 layer 516, metal 2 layer 518, and the like, are all unique conductive layers separated by dielectric, or insulating layers, 812, 814, and 816, that allow them to be stacked. Depending on the design implementation, such as the color die 304 shown in FIGS. 8A and 8B, a crack detector, and the like, the various layers are used in different combinations to form the VPP, PGND, and digital control connections to drive the FETs and TIJ Resistors.

Figure 9:
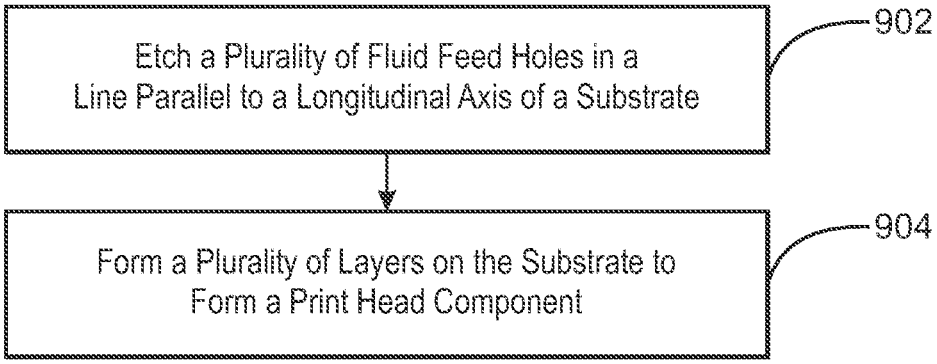
FIG. 9 is a process flow diagram of an example of a method for forming a die.

FIG. 9 is a process flow diagram of an example of a method 900 for forming a die. The method 900 may be used to make the color die 304 used as a die for color printers, as well as the black die 302 used for black inks, and other types of dies that include fluidic actuators. The method 900 begins at block 902 with the etching of the fluid feed holes through a silicon substrate, along a line parallel to a longitudinal axis of the substrate. In some examples, layers are deposited first, then the etching of the fluid feed holes is performed after the layers are formed.

In an example, a layer of photoresist polymer, such as SU-8, is formed over a portion of the die to protect areas that are not to be etched. The photoresist may be a negative photoresist, which is cross-linked by light, or a positive photoresist, which is made more soluble by light exposure. In an example, a mask is exposed to a UV light source to fix portions of the protective layer, and portions not exposed to UV light are washed away. In this example, the mask prevents cross-linking of the portions of the protective layer covering the area of the fluid feed holes.

At block 904, a plurality of layers is formed on the substrate to form the die. The layers may include the polysilicon, the dielectric over the polysilicon, metal 1, the dielectric over metal 1, metal 2, the passivation layer over metal 2, and the tantalum layer over the top. As described above, the SU-8 may then be layered over the top of the die, and patterned to implement the flow channels and nozzles. The formation of the layers may be formed by chemical vapor deposition to deposit the layers followed by etching to remove portions that are not needed. The fabrication techniques may be the standard fabrication used in forming complementary metal-oxide-semiconductors (CMOS). The layers that can be formed in block 904 and the location of the components is discussed further with respect to FIG. 10.

Figure 10:
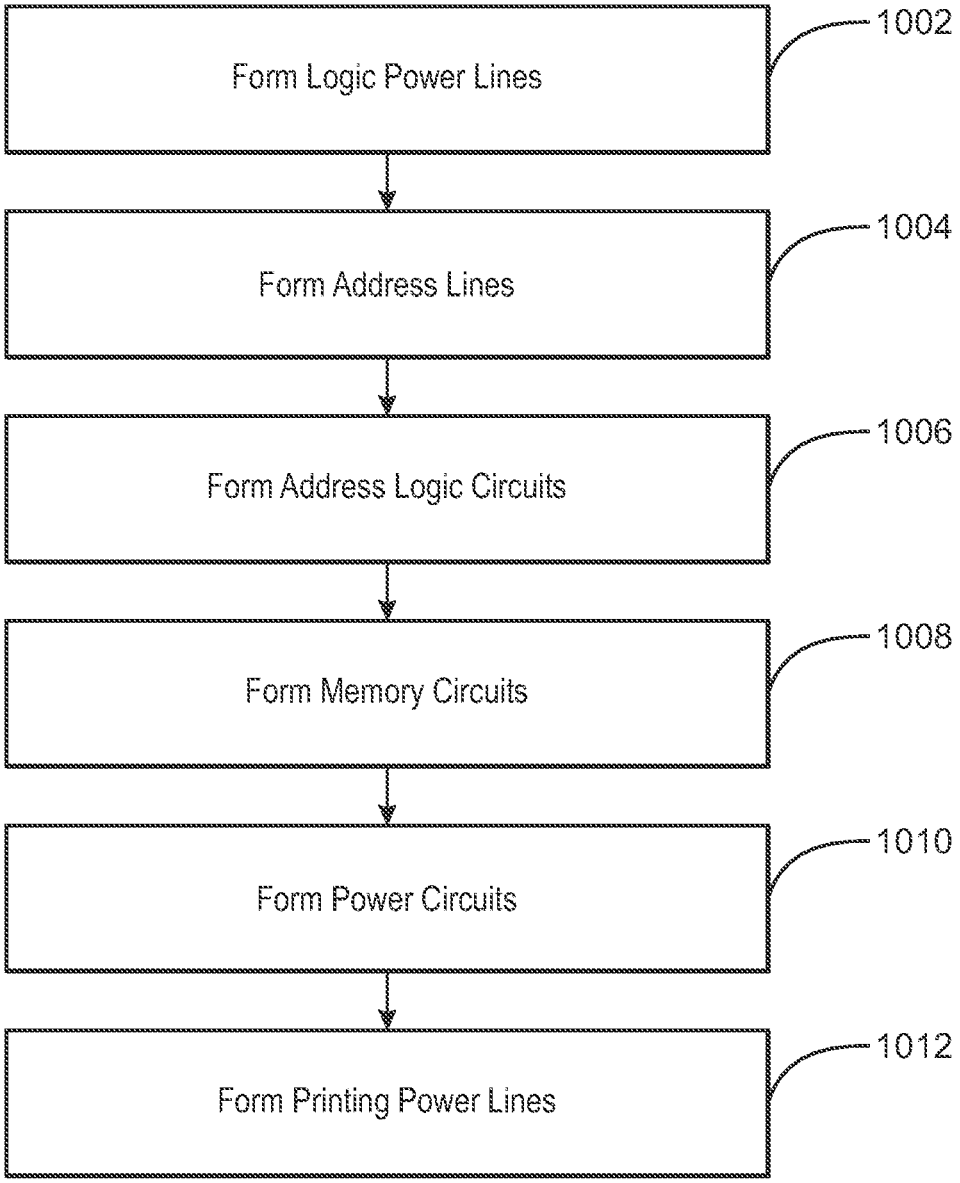
FIG. 10 is a process flow diagram of an example of a method for forming components on a die using a plurality of layers.
Figure 12:
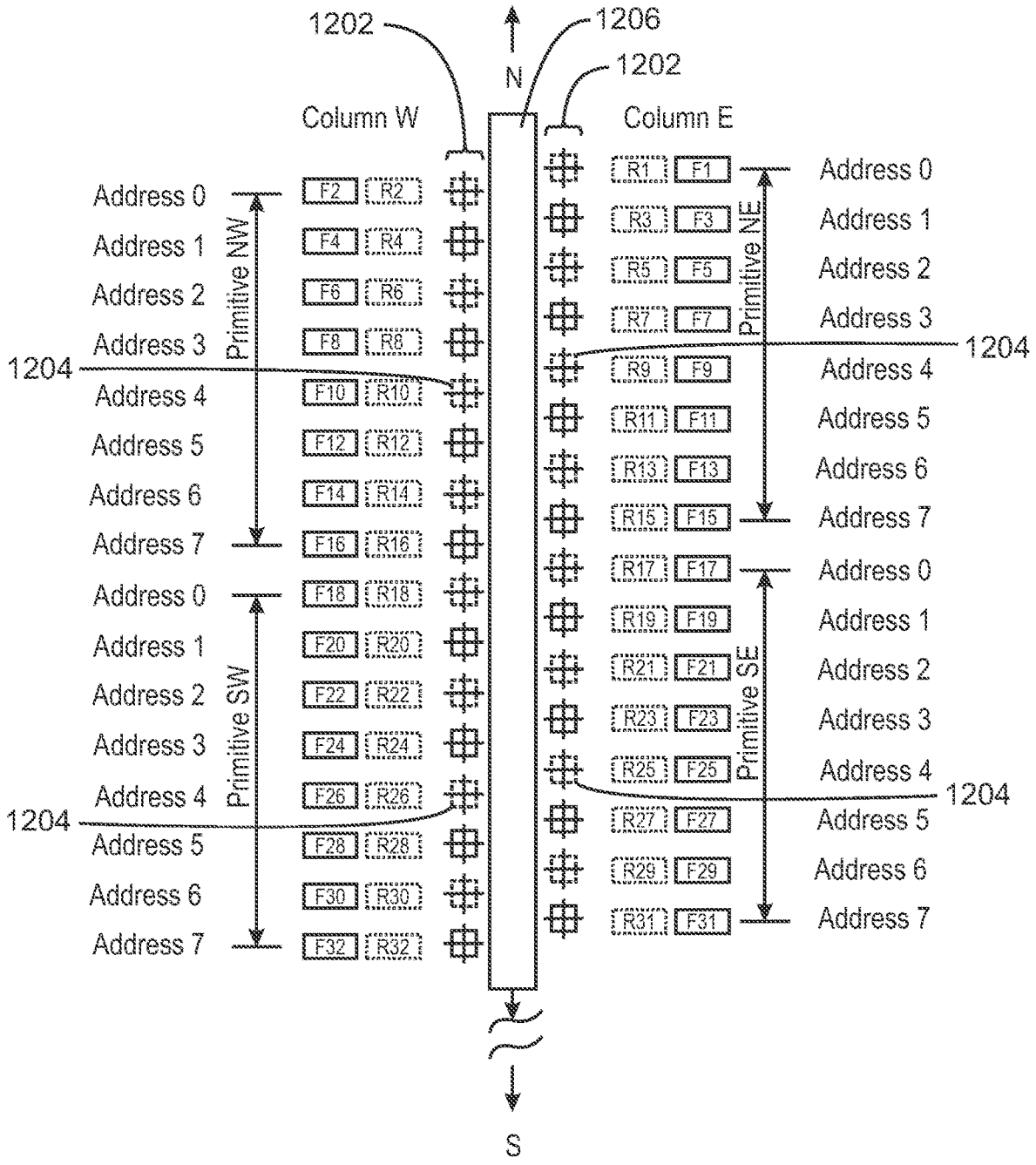
FIG. 12 is a schematic diagram of an example of a set of four primitives, termed a quad primitive.
Figure 13:
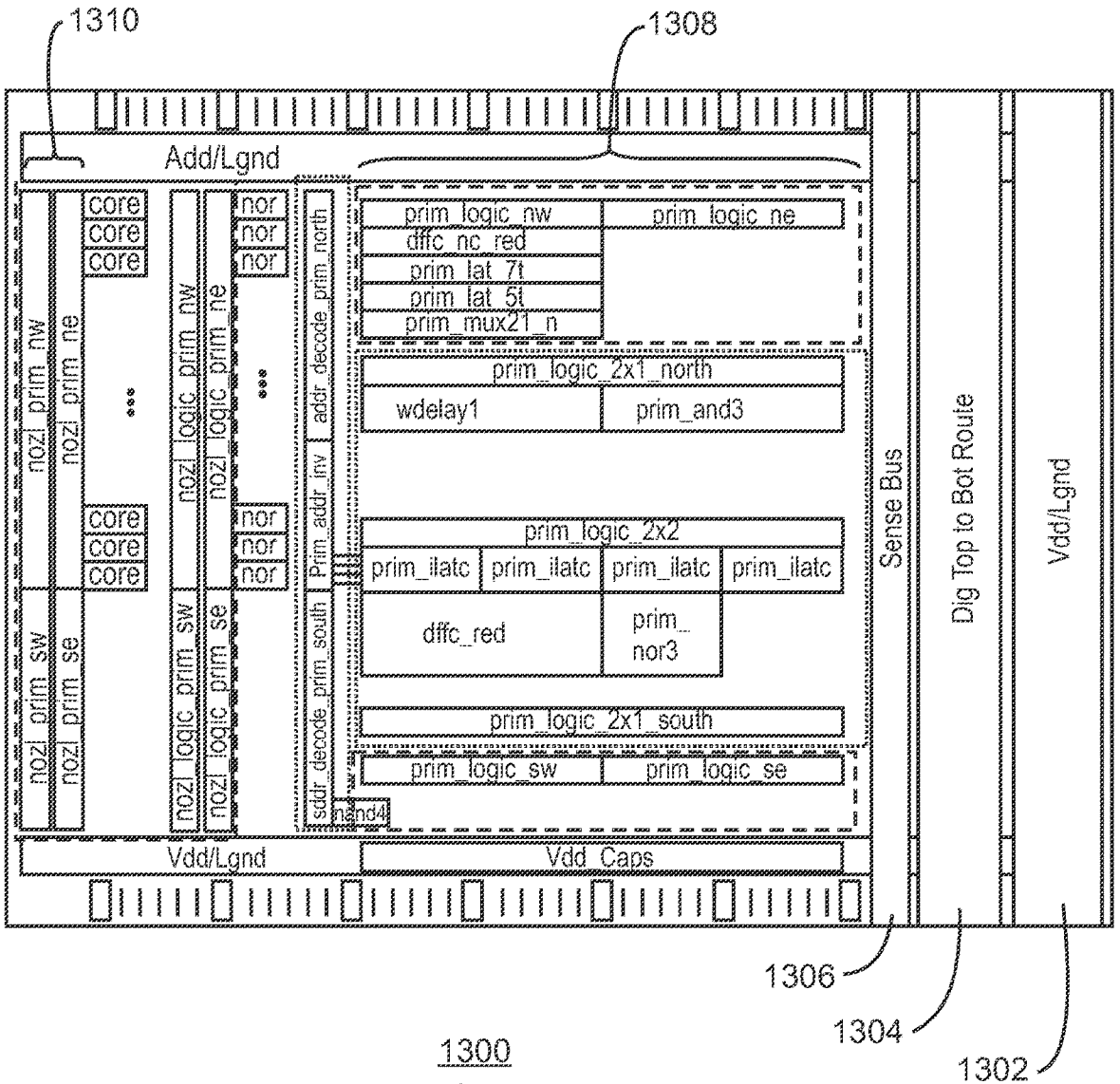
FIG. 13 is a drawing of an example of a layout of the digital circuitry, showing the simplification that can be achieved by a single set of nozzle circuitry.

FIG. 10 is a process flow diagram of an example of a method 1000 for forming components on a die using a plurality of layers. In an example, the method 1000 shows details of the layers that may be formed in block 904 of FIG. 9. The method begins at block 1002 with forming logic power circuits on the die. At block 1004, address line circuits, including address lines for primitive groups, as described with respect to FIGS. 12 and 13, are formed on the die. At block 1006, address logic circuits, including decode circuits, as described with respect to FIGS. 12 and 13, are formed on the die. At block 1008, memory circuits are formed on the die. At block 1010 power circuits are formed on the die. At block 1012, power lines are formed in the die. The blocks shown in FIG. 10 are not to be considered sequential. As would be to one of skill in the art, the various lines and circuits are formed across the die at the same time as the various layers are formed. Further, the processes described with respect to FIG. 10 may be used to form components on either a color die or a black-and-white die.

As described herein, the use of the fluid feed holes allow circuitry to cross the die in traces formed over silicon between the fluid feed holes. Accordingly, circuits may be shared between each side of the die, decreasing the total amount of circuits needed on the die.

Figure 11:
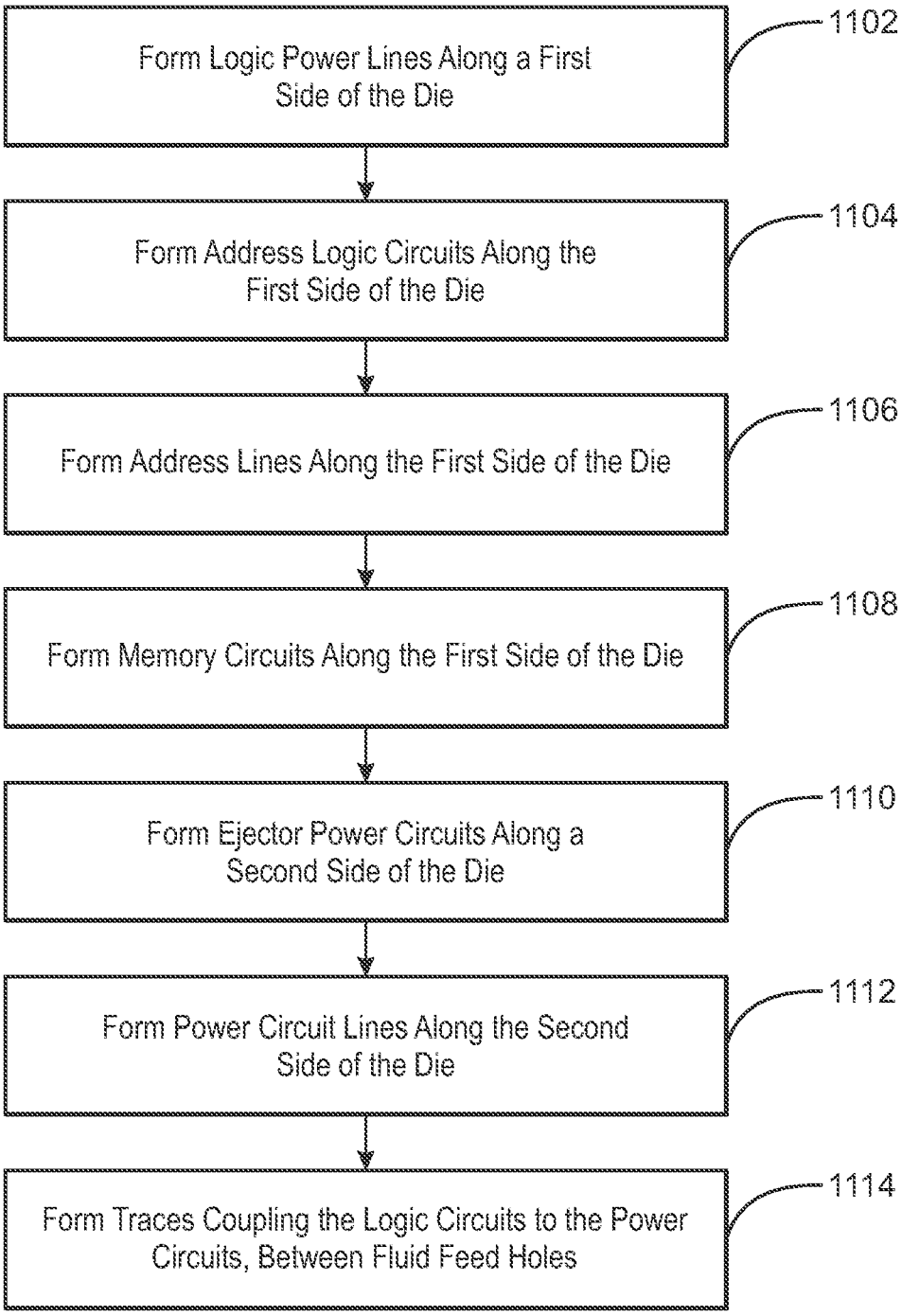
FIG. 11 is a process flow diagram of an example of a method for forming circuitry on a die with traces coupling circuitry on each side of the die.

FIG. 11 is a process flow diagram of an example of a method 1100 for forming circuitry on a die with traces coupling circuitry on each side of the die. As used herein, a first side of the die and a second side of the die denote the long edges of the die in alignment with the fluid feed holes placed near or at the center of the die. The method 1100 begins at block 1102 with the formation of logic power lines along a first side of the die. The logic power lines are low-voltage lines used to supply power to the logic circuits, for example, at a voltage of about 2 to about 7 V, and associated ground lines for the logic circuits. At block 1104, address logic circuits are formed along the first side of the die. At block 1106, address lines are formed along the first side of the die. At block 1108, memory circuits are formed along the first side of the die.

At block 1110, ejector power circuits are formed along a second side of the die. In some examples, the ejector power circuits include field-effect transistors (FETs) and thermal inkjet (TIJ) resistors used to heat a fluid to force the fluid to be ejected from a nozzle. At block 1112, power circuit power lines are formed along the second side of the die. The power circuit power lines are high-voltage power lines (Vpp) and return lines (Pgnd) used to supply power to the ejector power circuits, for example, at a voltage of about 25 to about 35 V.

At block 1114, traces coupling the logic circuits to power circuits, between the fluid feed holes, are formed. As described herein, the traces may carry signals from logic circuits located on the first side of the die to power circuits on the second side of the die. Further, traces may be included to perform crack detection between the fluid feed holes, as described herein.

In dies in which the nozzle circuitry is separated by a center fluid feed slot, logic circuitry, address lines, and the like are repeated on each side of the center fluid feed slot. In contrast, in dies formed using the methods of FIGS. 9 to 11 the ability to route circuitry from one side of the die to the other side of the die eliminates the need to duplicate some circuitry on both sides of the die. This is clarified by looking at physical structure circuitry on the die. In some examples described herein, the nozzles are grouped into individually addressed sets, termed primitives, as discussed further with respect to FIG. 12.

FIG. 12 is a schematic diagram 1200 of an example of a set of four primitives, termed a quad primitive. To facilitate the explanation of the primitives and the shared addressing, primitives to the right of the schematic diagram 1200 are labeled east, e.g., northeast (NE) and southeast (SE). Primitives to the left of the schematic diagram 1200 are labeled west, e.g., northwest (NW) and southwest (SW). In this example, each nozzle 1202 is fired by an FET that is labeled Fx, where x is from 1 to 32. The schematic diagram 1200 also shows the TIJ resistors, labeled Rx, where x is also 1 to 32, which correspond to each nozzle 1202. Although the nozzles are shown on each side of the fluid feed in the schematic diagram 1200, this is a virtual arrangement. In a color die 304 formed using the current techniques, the nozzles 1202 would be on the same side of the fluid feed.

In each primitive, NE, NW, SE, and SW, eight addresses, labeled 0 to 7, are used to select a nozzle for firing. In other examples, there are 16 addresses per primitive, and 64 nozzles per quad primitive. The addresses are shared, wherein an address selects a nozzle in each group. In this example, if address four is provided, then nozzles 1204, activated by FETs F9, F10, F25, and F26 are selected for firing. Which, if any, of these nozzles 1204 fire depends on separate primitive selections, which are unique to each primitive. A fire signal is also conveyed to each primitive. A nozzle within a primitive is fired when address data conveyed to that primitive selects a nozzle for firing, data loaded into that primitive indicates firing should occur for that primitive, and a firing signal is sent.

In some examples, a packet of nozzle data, referred to herein as a fire pulse group (FPG), includes start bits used to identify the start of an FPG, address bits used to select a nozzle 1202 in each primitive data, fire data for each primitive, data used to configure operational settings, and FPG stop bits used to identify the end of an FPG. Once an FPG has been loaded, a fire signal is sent to all primitive groups which will fire all addressed nozzles. For example, to fire all the nozzles on the printhead, an FPG is sent for each address value, along with an activation of all the primitives in the printhead. Thus, eight FPG's will be issued each associated with a unique address 0-7. The addressing shown in the schematic diagram 1200 may be modified to address concerns of fluidic crosstalk, image quality, and power delivery constraints. The FPG may also be used to write to a non-volatile memory element associated with each nozzle, for example, instead of firing the nozzle.

A central fluid feed region 1206 may include fluid feed holes or a fluid feed slot. However, if the central ink feed region 1206 is a fluid feed slot, the logic circuitry and addressing lines, such as the three address lines in this example that are used provide addresses 0-7 for selecting a nozzle to fire each primitive, are duplicated, as traces cannot cross the central ink feed region 1206. If, however, the central fluid feed region 1206 is made up of fluid feed holes, each side can share circuitry, simplifying the logic.

Although the nozzles 1202 in the primitives described in FIG. 12 are shown on opposite sides of the die, for example, on each side of the central fluid feed region 1206, this is a virtual arrangement. The location of the nozzles 1202 in relation to the central ink feed region 1206 depends on the design of the die, as described in the following figures. In an example, a black die 302 has staggered nozzles on each side of the fluid feed hole, wherein the staggered nozzles are of the same size. In another example, a color die 304 has a line of nozzles in a line parallel to a longitudinal axis of the die, wherein the size of the nozzles in the line of nozzles alternates between larger nozzles and smaller nozzles.

FIG. 13 is a drawing of an example of a layout 1300 of the digital circuitry, showing the simplification that can be achieved by a single set of nozzle circuitry. The layout 1300 can be used for either the black die 302 of the color die 304. In the layout 1300, a digital power bus 1302 provides power and ground to all logic circuits. A digital signal bus 1304 provides address lines, primitive selection lines, and other logic lines to the logic circuits. In this example, a sense bus 1306 is shown. The sense bus 1306 is a shared, or multiplexed, analog bus that carries sensor signals, including, for example, signals from temperature sensors, and the like. The sense bus 1306 may also be used to read the non-volatile memory elements.

In this example, logic circuitry 1308 for primitives on both the east and west side of the die share access to the digital power bus 1302, digital signal bus 1304, and the sense bus 1306. Further, the address decoding may be performed in a single logic circuit for a group of primitives 1310, such as the primitives NW and NE. As a result, the total circuitry required for the die is decreased.

Figure 14:
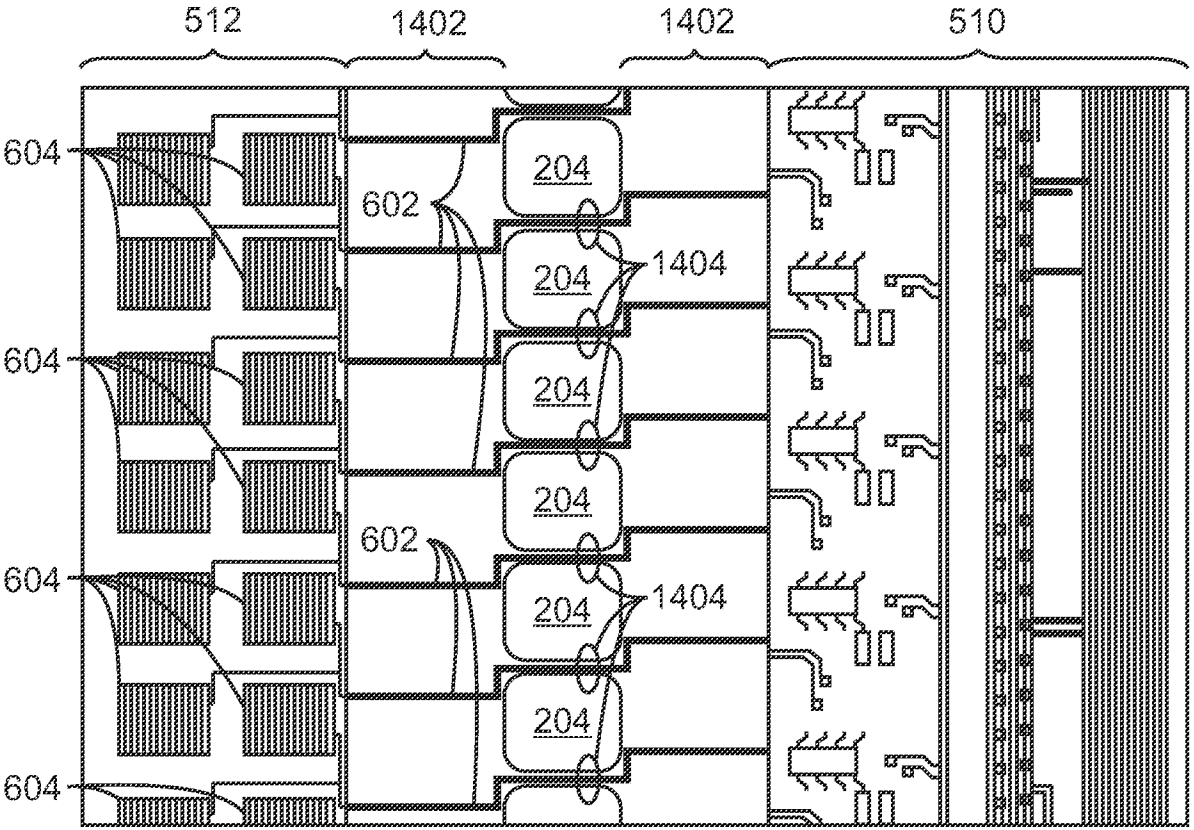
FIG. 14 is a drawing of an example of a black die, showing the impact of cross-slot routing on energy and power routing.

FIG. 14 is a drawing of an example of a black die 302, showing the impact of cross-slot routing on energy and power routing. Like numbered items are as described with respect to FIGS. 2 and 6. As a black die 302 is shown in this example, the TIJ resistors are on either side of the fluid feed holes 204. A similar structure would be used in a color die 304, although the TIJ resistors would be on a single side of the fluid feed holes 204 and would alternate in size. Connecting power straps 1402 across the silicon ribs 1404 between the fluid feed holes 204 increases the effective width of the power bus for delivering current to the TIJ resistors. In previous solutions that use a slot for ink feed, the right and left column power routing cannot contribute to the other column. Further, using metal 1 and metal 2 layers as a power plane running between fluid feed holes enables the left column (east) and right column (west) of nozzles to share common ground and supply busing. The traces 602 that connect the logic circuitry 510 of the black die 302 to the FETs 604 in the power circuitry 512 of the black die 302 are also visible in the drawing.

Figure 15:
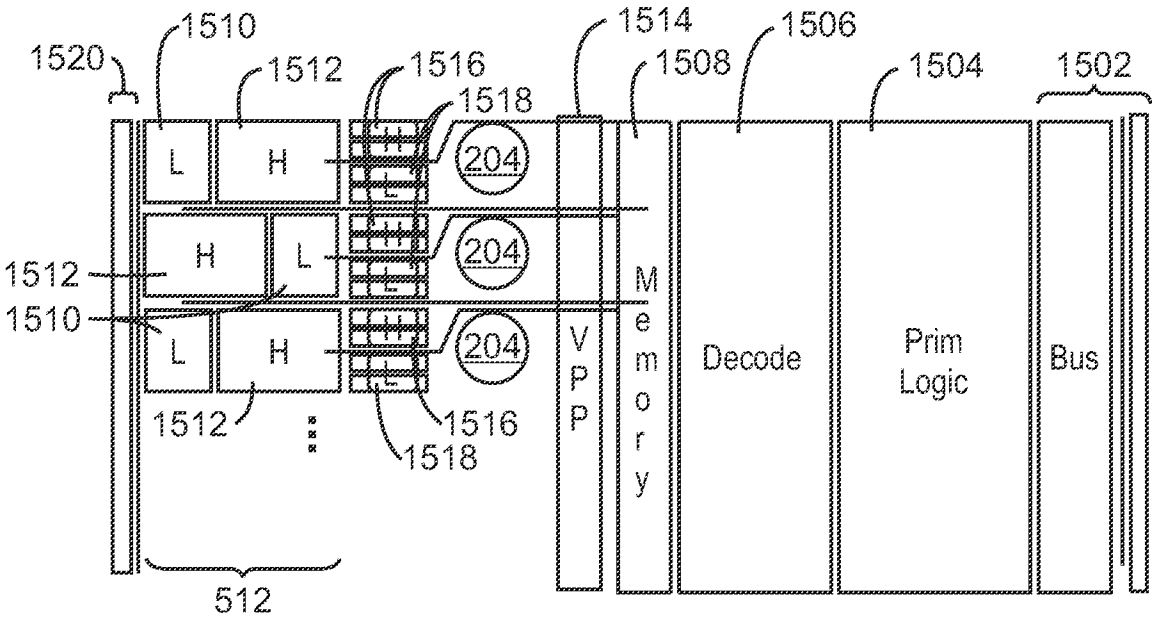
FIG. 15 is a drawing of an example of a circuit floorplan for a color die.

FIG. 15 is a drawing of an example of a circuit floorplan illustrating a number of die zones for a color die 304. Like numbered items are as described with respect to FIGS. 2, 3, and 5. In the color die 304, a bus 1502 carries control lines, data lines, address lines, and power lines for the primitive logic circuitry 1504, including a logic power zone that includes a common logic power line (Vdd) and a common logic ground line (Lgnd) to provide a supply voltage at about 5 V for logic circuitry. The bus 1502 also includes an address line zone including address lines used to indicate an address for a nozzle in each primitive group of nozzles. Accordingly, the primitive group is a group or subset of fluidic actuators of the fluidic actuators on the color die 304.

An address logic zone includes address line circuits, such as primitive logic circuitry 1504 and decode circuitry 1506. The primitive logic circuitry 1504 couples the address lines to the decode circuitry 1506 for selecting a nozzle in a primitive group. The primitive logic circuitry 1504 also stores data bits loaded into the primitive over the data lines. The data bits include the address values for the address lines, and a bit associated with each primitive that selects whether that primitive fires an addressed nozzle or saves data.

The decode circuitry 1506 selects a nozzle for firing or selects a memory element in a memory zone that includes non-volatile memory elements 1508, to receive the data. When a fire signal is received over the data lines in the bus 1502, the data is either stored to a memory element in the non-volatile memory elements 1508 or used to activate an FET 1510 or 1512 in a power circuitry zone on the power circuitry 512 of the color die 304. Activation of an FET 1510 or 1512 provides power to a corresponding TIJ resistor 1516 or 1518 from a shared power (Vpp) bus 1514. In this example, the traces include power circuitry to power TIJ resistors 1516 or 1518. Another shared power bus 1520 may be used to provide a ground for the FETs 1510 and 1512. In some examples, the Vpp bus 1514 and the second shared power bus 1520 may be reversed.

A fluid feed zone includes the fluid feed holes 204 and the traces between the fluid feed holes 204. For the color die 304, two droplet sizes may be used, which are each ejected by thermal resistors associated with each nozzle. A high weight droplet (HWD) may be ejected using a larger TIJ resistor 1516. A low weight droplet (LWD) may be ejected using a smaller TIJ resistor 1518. Electrically, the HWD nozzles are in the first column, for example, west, as described with respect to FIGS. 12 and 13. The LWD nozzles are electrically coupled in a second column, for example, east, as described with respect to FIGS. 12 and 13. In this example, the physical nozzles of the color die 304 are interdigitated, alternating HWD nozzles with LWD nozzles.

The efficiency of the layout may be further improved by changing the size of the corresponding FETs 1510 and 1512 to match the power demand of the TIJ resistors 1516 and 1518. Accordingly, in this example, the size of the corresponding FETs 1510 and 1512 are based on the TIJ resistor 1516 or 1518 being powered. A larger TIJ resistor 1516 is activated by a larger FET 1512, while a smaller TIJ resistor 1518 is activated by a smaller FET 1510. In other examples, the FETs 1510 and 1512 are the same size, although the power drawn through the FETs 1510 used to power smaller TIJ resistors 1518 is lower.

A similar circuit floorplan may be used for a black die 302. However, as described for examples herein, the FETs for a black die are the same size, as the TIJ resistors and nozzles are the same size.

Figure 16:
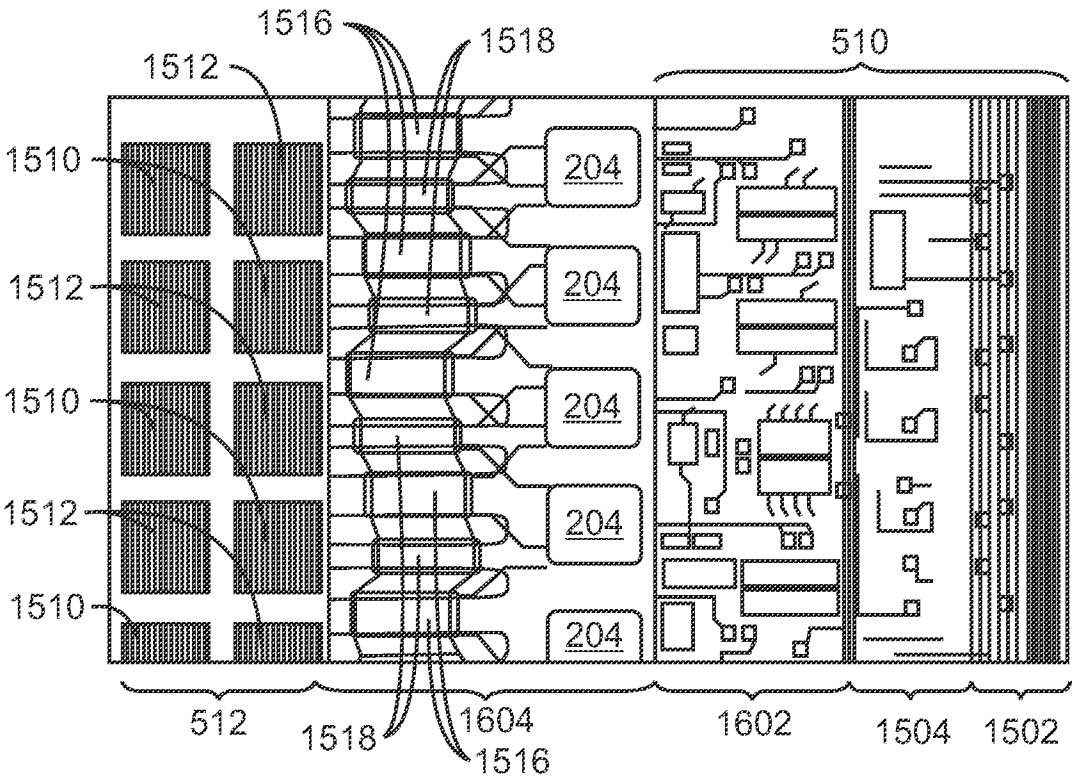
FIG. 16 is another drawing of an example of a color die.

FIG. 16 is another drawing of an example of a color die 304. Like numbered items are as described with respect to FIGS. 3, 5, and 15. As can be seen in the drawing, the TIJ resistors 1516 and 1518 are placed in a line parallel to a longitudinal axis of the color die 304, along one side of the fluid feed holes 204. The grouping of the TIJ resistors 1516 and 1518 with the fluid feed holes 204 may be termed a micro-electrical mechanical systems (MEMS) area 1604. Further, in this drawing, the decoding circuitry 1506 and the non-volatile memory elements 1508 are included together in a circuitry section 1602. The FETs 1510 and 1512 are shown as the same size in the drawing of FIG. 16. However, in some examples the FETs 1510, which activate the smaller TIJ resistors 1518, are smaller than the FETs 1512, which activate the larger TIJ resistors 1516, as described with respect to FIG. 15. Thus, the dies, both color and black, have repeating structures that optimize the power delivery capability of the printhead, while minimizing the size of the dies.

Figure 17:
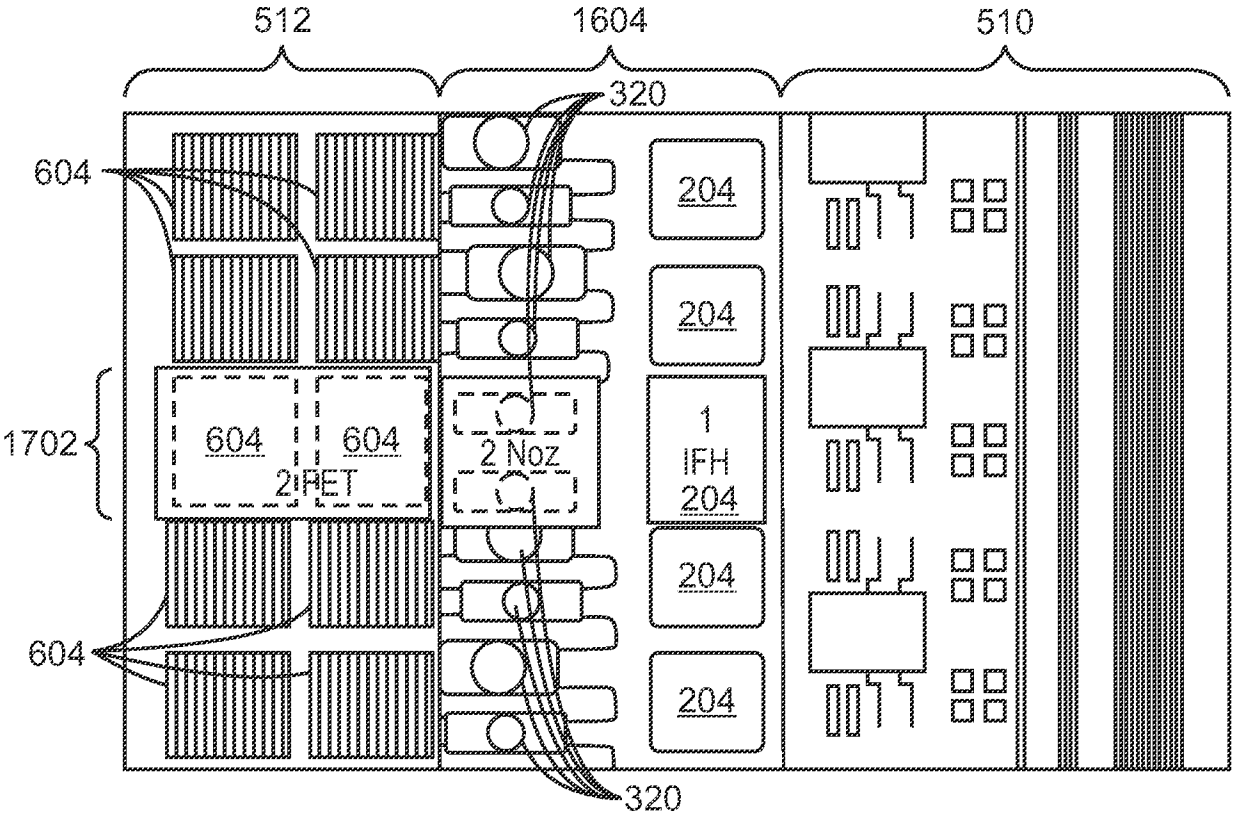
FIG. 17 is a drawing of an example of a color die showing a repeating structure.

FIG. 17 is a drawing of an example of a color die 304 showing a repeating structure 1702. Like numbered items are as described with respect to FIGS. 5 and 16. As discussed herein, the use of the fluid feed holes 204 allows the routing of low-voltage control signals from logic circuitry to connect to high-voltage FETs between the fluid feed holes 204. As a result, the repeating structure 1702 includes two FETs 604, two nozzles 320, and one fluid feed hole 204. For a color die 304 with 1200 dots per inch, this provides a repeating pitch of 42.33 μm. As the FETs 604 and nozzles 320 are only to one side of the fluid feed hole 204, the circuit area requirements are reduced which allows a smaller size for the color die 304, versus the black die 302.

Figure 18:
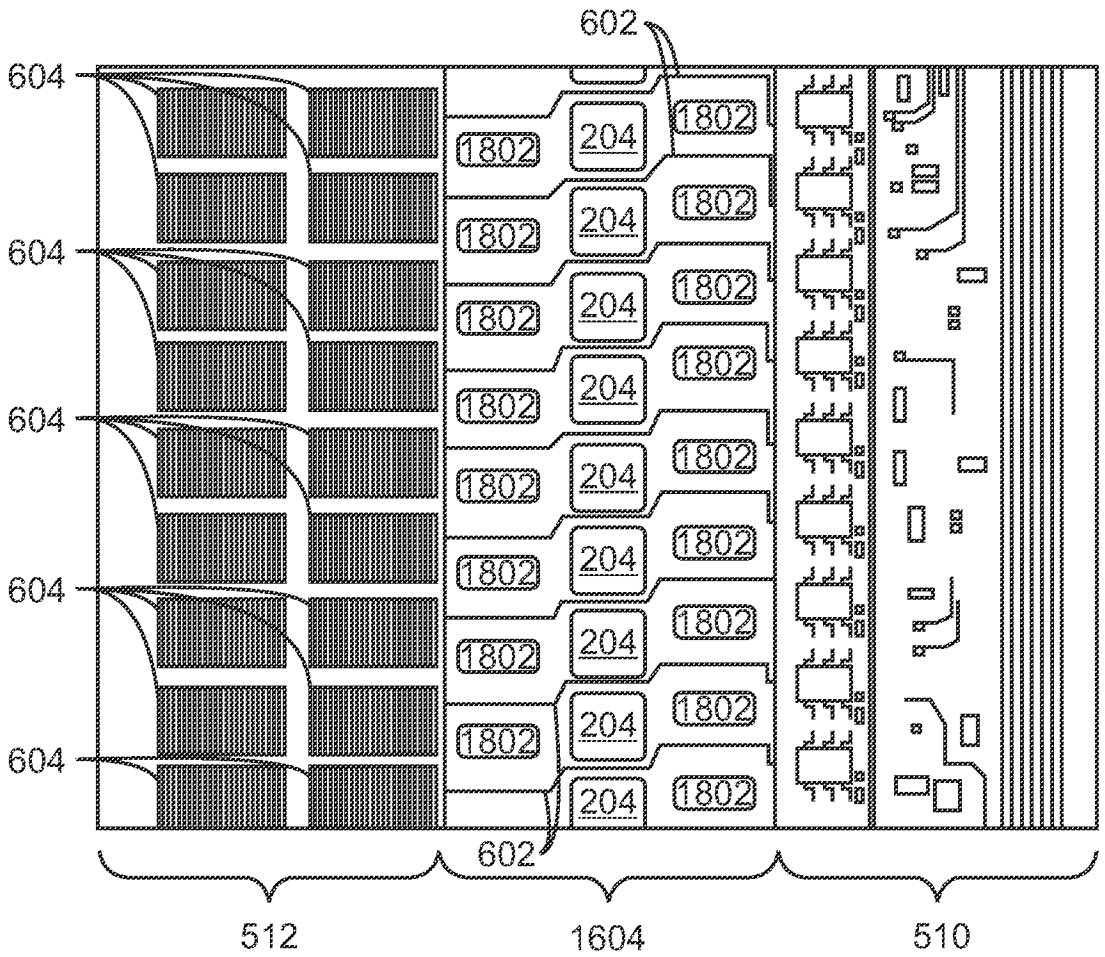
FIG. 18 is a drawing of an example of a black die showing an overall structure for the die.

FIG. 18 is a drawing of an example of a black die 302 showing an overall structure for the die. Like numbered items are as described with respect to FIGS. 2, 3, 6, and 16. In this example, the TIJ resistors 1802 are on either side of the fluid feed holes 204, allowing the nozzles to be of a similar size, while maintaining the close vertical spacing, or a dot pitch. In this example, the FETs 604 are all the same size to drive the TIJ resistors 1802. The logic circuitry 510 of the black die 302 is laid out in the same configuration as the logic circuitry 510 of a color die 304, described with respect to FIG. 15. Accordingly, traces 602 couple the logic circuitry 510 to FETs 604 in the power circuitry 512.

Figure 19:
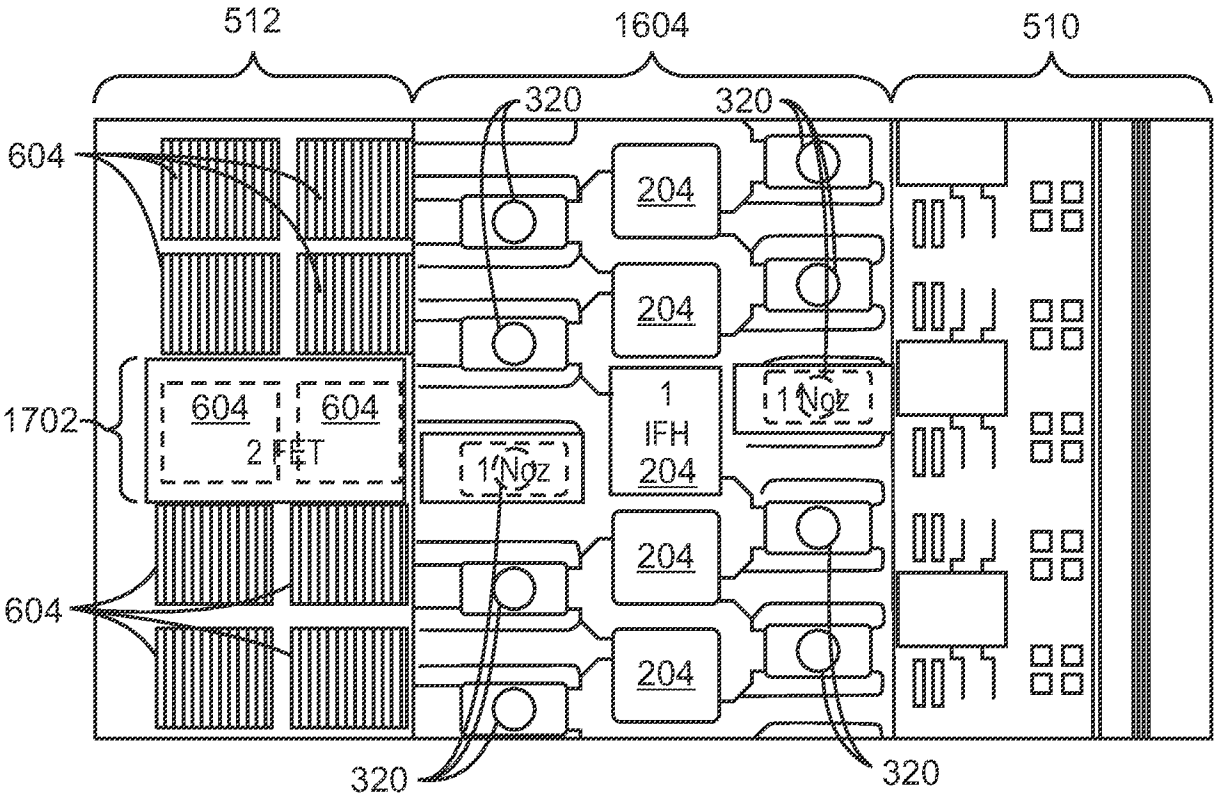
FIG. 19 is a drawing of an example of a black die showing a repeating structure.

FIG. 19 is a drawing of an example of a black die 302 showing a repeating structure 1702. Like numbered items are as described with respect to FIGS. 5, 6, 16, and 17. As described with respect to the color die 304, because the low-voltage control signals that connect to high-voltage FETs can be routed between the fluid feed holes 204 a new column circuit architecture and layout is possible. This layout includes a repeating structure 1702 that has two FETs 604, two nozzles 320, and one fluid feed hole 204. This is similar to the repeating structure of the color die 304. However, in this example, one nozzle 320 is to the left of the fluid feed hole 204 and one nozzle 320 is to the right of the fluid feed hole 204 in repeating structure 1702. This design accommodates larger firing nozzles, for higher ink drop volumes, while maintaining lower circuit area requirements and optimizing the layout to allow a smaller die. As for the color die 304, the cross-slot routing is performed in multiple metal layers exit naturally speaking, including poly silicon layers and aluminum copper layers, among others.

The black die 302 is wider than the color die 304, since nozzles 320 are on both sides of the fluid feed holes 204. In some examples, the black die 302 is about 400 to about 450 μm. In some examples, the color die 304 is about 300 to about 350 μm.

Figure 20:
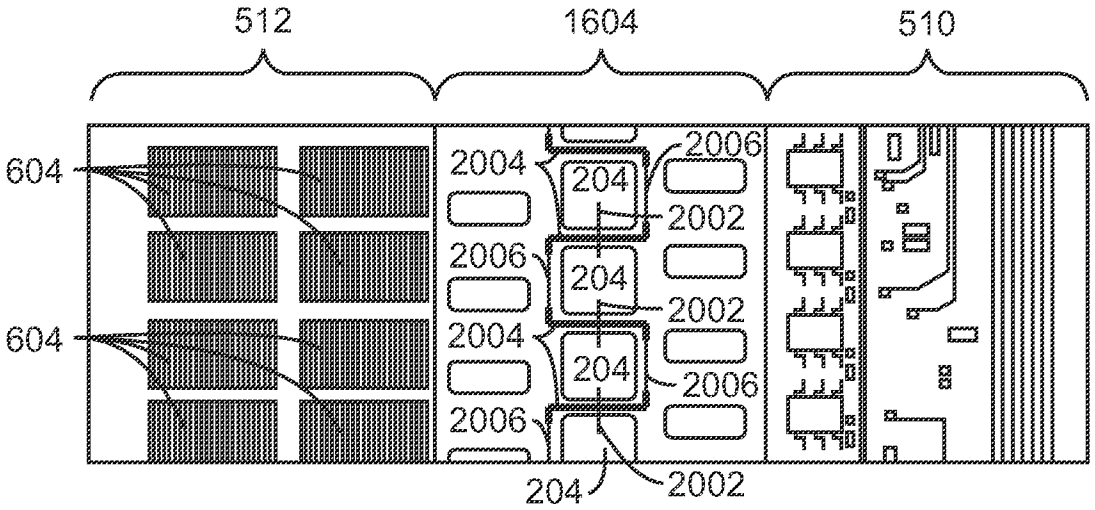
FIG. 20 is a drawing of an example of a black die showing a system for crack detection.

FIG. 20 is a drawing of an example of a black die 302 showing a system for crack detection. Like numbered items are as described with respect to FIGS. 2, 3, 5, 6, and 16. The introduction of an array of fluid feed holes 204 in a line parallel to the longitudinal axis of the black die 302 increases the fragility of the die. As described herein, the fluid feed holes 204 can act like a perforation line along the longitudinal axis of either the black die 302 or the color die 304, allowing cracks 2002 to form between these features. To detect these cracks 2002, a trace 2004 is routed between each fluid feed hole 204 to function as an embedded crack detector. In an example, with a crack forms, the trace 2004 is broken. As a result, the conductivity of the trace 2004 drops to zero.

The trace 2004 between the fluid feed holes 204 may be made from a brittle material. While metal traces may be used, the ductility of the metal may allow it to flex across cracks that have formed without detecting them. Accordingly, in some examples the trace 2004 between fluid feed holes 204 are made from polysilicon. If the trace between the fluid feed holes 204 throughout the black die 302, both alongside and between the fluid feed holes 204, were made from polysilicon, the resistance may be as high as several megaohms. In some examples, to reduce the overall resistance and improve the detectability of cracks, the portions 2006 of the trace 2004 formed alongside the fluid feed holes 204 and connecting the traces 2004 between the fluid feed holes 204 are made from a metal, such as aluminum-copper, among others.

Figure 21:
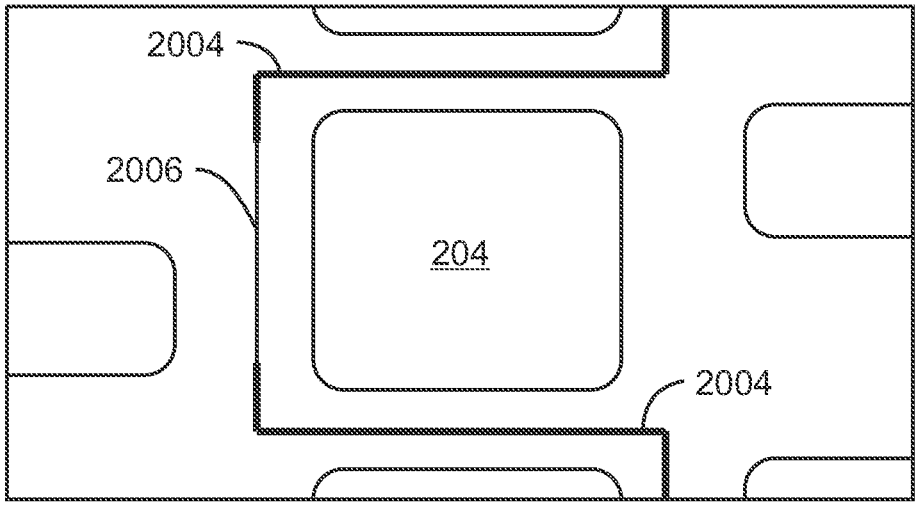
FIG. 21 is an expanded view of an example of a fluid feed hole from a black die showing the crack detection trace routed around the fluid feed hole.

FIG. 21 is an expanded view of a fluid feed hole 204 from a black die 302 showing the trace 2004 routed between adjacent fluid feed holes 204. In this example, the trace 2004 between the fluid feed holes 204 is formed from polysilicon, while the portion 2006 of the trace 2004 beside the fluid feed holes 204 is formed from a metal.

Figure 22:
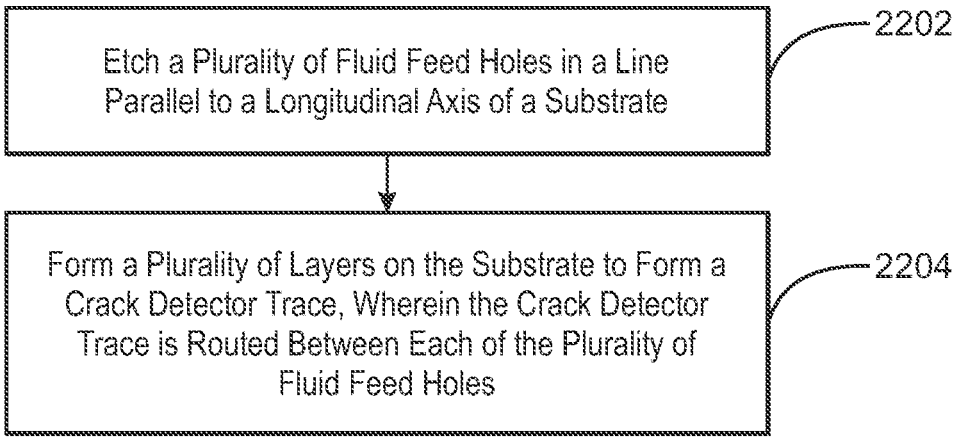
FIG. 22 is a process flow diagram of an example of a method for forming a crack detection trace.

FIG. 22 is a process flow diagram of an example of a method 2200 for forming a crack detection trace. The method begins at block 2202, with the etching of a number of fluid feed holes in a line parallel to a longitudinal axis of a substrate.

At block 2204, a number of layers are formed on the substrate to form the crack detector trace, wherein the crack detector trace is routed between each of the plurality of fluid feed holes on the substrate. As described herein, the layers are formed to loop from side to side of the die, between each pair of adjacent fluid feed holes, along the outside of a next fluid feed hole, and then between the next pair of adjacent fluid feed holes. In examples, layers are formed to couple the crack detector trace to a sense bus that is shared by other sensors on the die, such as the thermal sensors described with respect to FIG. 2. The sense bus is coupled to a pad to allow the sensor signals to be read by an external device, such as the ASIC described with respect to FIG. 2.

The present examples may be susceptible to various modifications and alternative forms and have been shown only for illustrative purposes. Furthermore, it is to be understood that the present techniques are not intended to be limited to the particular examples disclosed herein. Indeed, the scope of the appended claims is deemed to include all alternatives, modifications, and equivalents that are apparent to persons skilled in the art to which the disclosed subject matter pertains.

What is claimed is:

1. A die for a printhead, comprising:

a plurality of fluid feed holes disposed in a line parallel to a longitudinal axis of the die;

a plurality of fluidic actuators disposed in a line parallel to the plurality of fluid feed holes; and a crack detector trace routed between and alongside each of the plurality of fluid feed holes, wherein parts of the crack detector trace between the fluid feed holes are brittle and parts of the crack detector trace alongside the fluid feed holes are not brittle.

2. The die of claim 1, wherein the plurality of fluid feed holes is etched through a silicon substrate of the die.

3. The die of claim 1, wherein the brittle parts of the crack detector trace comprise polysilicon.

4. The die of claim 1, wherein the not brittle parts of the crack detector trace comprise metal.

5. The die of claim 1, wherein the brittle parts of the crack detector trace comprise polysilicon and the not brittle parts of the crack detector trace comprise metal.

6. The die of claim 1, wherein the crack detector trace is conductively connected to an external sense pad by a sense bus.

7. The die of claim 6, wherein the sense bus is shared by a thermal sensor, the thermal sensor being separate from the crack detector trace.

8. The die of claim 7, wherein both the crack detector trace and the thermal sensor are disposed on a same silicon die.

9. A method for forming a crack detector trace on a die for a printhead, comprising:

etching a plurality of fluid feed holes in a line parallel to a longitudinal axis of a substrate; and forming the crack detector trace in a plurality of layers on the substrate between and alongside each of the plurality of fluid feed holes including forming parts of the crack detector trace between the fluid feed holes from a brittle material and parts of the crack detector trace alongside the fluid feed holes from a non-brittle material.

10. The method of claim 9, wherein the brittle material comprises polysilicon.

11. The method of claim 9, wherein the non-brittle material comprises metal.

12. The method of claim 9, wherein the brittle material comprises polysilicon and the non-brittle material comprises metal.

13. The method of claim 9, comprising forming layers that conductively connect the crack detector trace to a sense bus shared by a thermal sensor separate from the crack detector trace.

14. A die for a printhead, comprising:

a plurality of fluid feed holes disposed in a line parallel to a longitudinal axis of the die;

a plurality of fluidic actuators disposed in a line parallel to the plurality of fluid feed holes; and a crack detector trace routed between and alongside each of the plurality of fluid feed holes, wherein parts of the crack detector trace between the fluid feed holes have a first resistance and parts of the crack detector trace alongside each of the fluid feed holes have a second resistance less than the first resistance.

15. The die of claim 14, wherein the parts of the crack detector trace between the feed holes comprise polysilicon.

16. The die of claim 14, wherein the parts of the crack detector alongside the feed holes comprise metal.

17. The die of claim 14, wherein the parts of the crack detector trace between the feed holes comprise polysilicon and the parts of the crack detector trace alongside the feed holes comprise metal.

* * * * *